United States Patent [19]

Hansen

[11] 4,331,955

[45] May 25, 1982

[54] METHOD AND APPARATUS FOR SMOOTHING OUTLINES

[75] Inventor: Walter I. Hansen, Cold Spring Harbor, N.Y.

[73] Assignee: Eltra Corporation, Morristown, N.J.

[21] Appl. No.: 175,990

[22] Filed: Aug. 7, 1980

[51] Int. Cl.[3] ..... G09G 1/00

[52] U.S. Cl. ..... 340/728; 340/739; 354/7

[58] Field of Search ..... 340/728, 739, 741; 354/7

[56] References Cited

U.S. PATENT DOCUMENTS

| | | | |
|---|---|---|---|
| 3,742,484 | 6/1973 | Rosenthal | 340/739 |
| 3,996,673 | 12/1976 | Vorst et al. | 340/728 |
| 4,199,815 | 4/1980 | Kyte et al. | 340/728 X |
| 4,231,096 | 10/1980 | Hansen et al. | 354/7X |

*Primary Examiner*—David L. Trafton
*Attorney, Agent, or Firm*—Joel I. Rosenblatt

[57] ABSTRACT

A font storage system for a typesetter having an electronically controlled character imaging device includes a floppy disk and digital information stored on the floppy disk defining each character to be typeset. A series of vectors proceeding from a start point and extending around the character define the character outline. The vectors each are defined by start points, end points and the coordinate distances for each vector defining the slope and distance of each outline vector. The characters are encoded in digital form and at a normalized size. The electronic typesetter includes means for reducing or expanding the character size to type of various size characters from the single size or a normalized font size. Characters enlarged beyond a predetermined size may have excessive outline angles at the coincidence points of the contiguous outline vectors. A method and means is provided for identifying such excessive angles in enlarged characters and altering the outline encoding by replacing the originally encoded vectors with additional vectors in the character outline code to produce a smoother character outline with less pronounced angles. The method and apparatus identifies a critical character size, removes vector codes associated with the excessive angles and replaces it with new vector encoding to produce a smoother curve. The new character encoding with the replacement vectors is then accessed and imaged through an electro-optical imaging device to produce the typeset characters in the predetermined order, size and placement as originally desired.

46 Claims, 22 Drawing Figures

DATA MANAGEMENT SUBSYSTEM

FONT FILE STRUCTURE

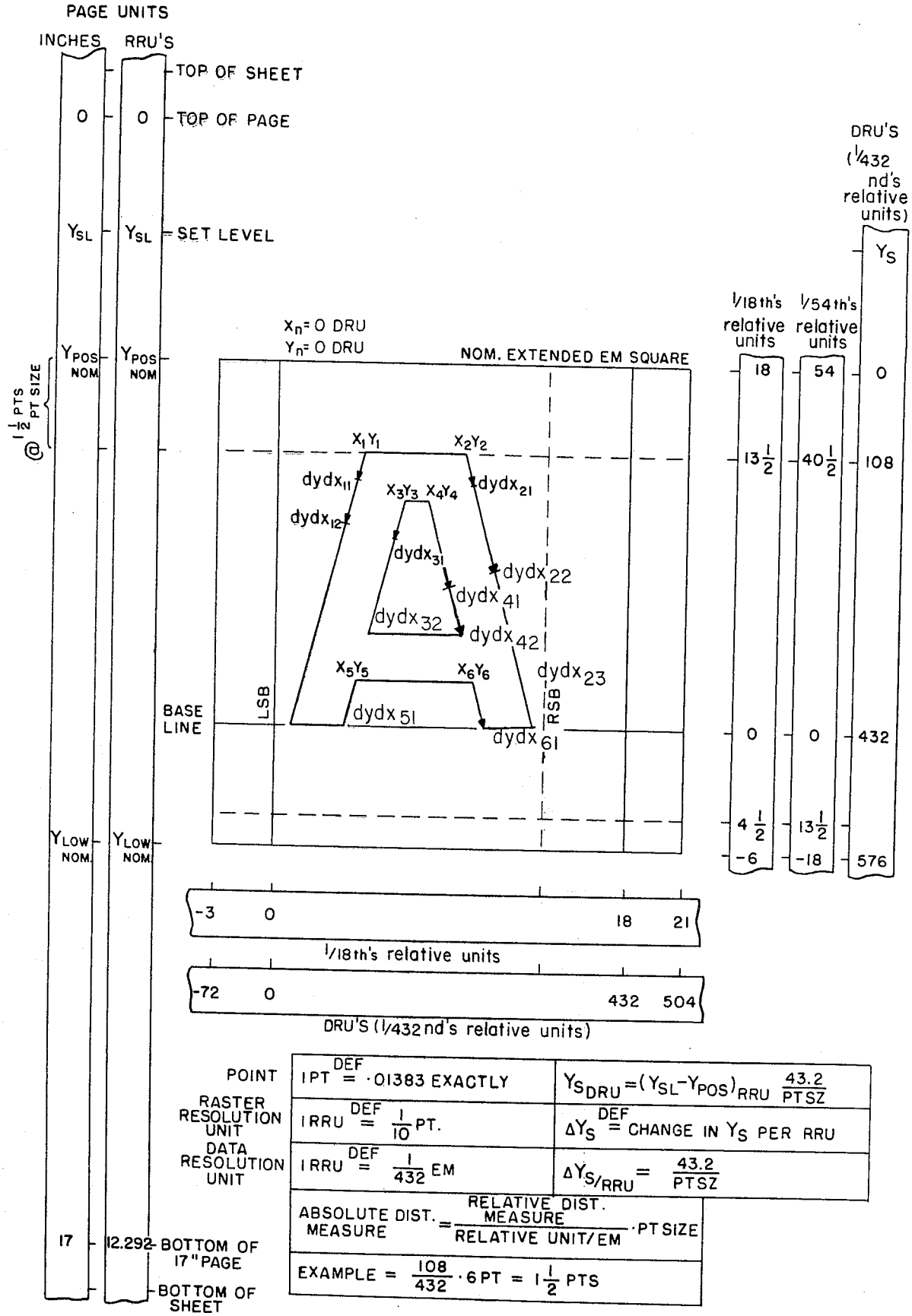

| | | |
|---|---|---|
| POINT | 1 PT $\overset{DEF}{=}$ ·01383 EXACTLY | $Y_{S_{DRU}} = (Y_{SL} - Y_{POS})_{RRU} \frac{43.2}{PTSZ}$ |
| RASTER RESOLUTION UNIT | 1 RRU $\overset{DEF}{=} \frac{1}{10}$ PT. | $\Delta Y_S \overset{DEF}{=}$ CHANGE IN $Y_S$ PER RRU |
| DATA RESOLUTION UNIT | 1 RRU $\overset{DEF}{=} \frac{1}{432}$ EM | $\Delta Y_{S/RRU} = \frac{43.2}{PTSZ}$ |
| ABSOLUTE DIST. MEASURE | $= \frac{\text{RELATIVE DIST. MEASURE}}{\text{RELATIVE UNIT/EM}} \cdot \text{PT SIZE}$ | |
| | EXAMPLE $= \frac{108}{432} \cdot 6\text{PT} = 1\frac{1}{2}$ PTS | |

CHARACTER DATA SCALING

FIG. 5

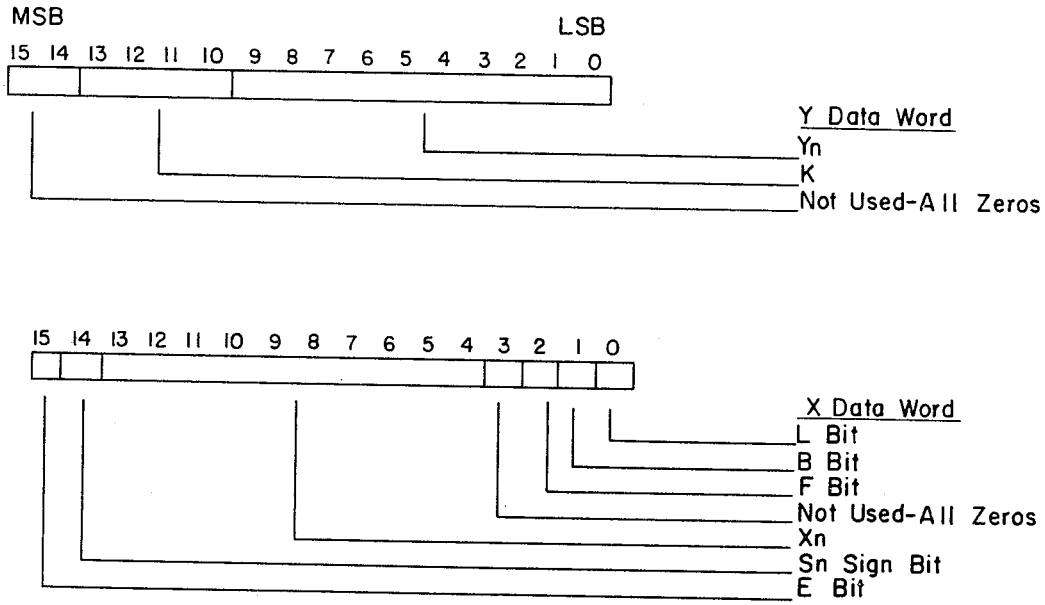
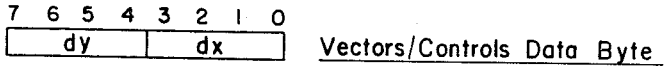
FIG.6 OUTLINE DATA WORDS

OUTLINE DATA FILE DISK STRUCTURE

HEADER AND OUTLINE DATA STRUCTURE

DATA RAM DOUBLE BUFFERING DESIGN

DATA MANAGEMENT
RAM BUILDING FLOW

DATA RAM LAYOUT

OUTLINE DATA IN DATA RAM

METHOD AND APPARATUS FOR SMOOTHING OUTLINES

BACKGROUND OF THE INVENTION

The present invention relates to the art of generating alphanumeric characters and other symbols for reproduction by an electro-optical scanner. Such an electro-optical scanner may be a Cathode Ray Tube (CRT) a laser beam scanner or other character imaging device capable of being electronically controlled.

In electro-optical typesetters, characters are commonly stored in digital encoded format. The characters are initially first designed on a fine grid or matrix and then digitally encoded from that matrix.

Encoding the characters on a normalized font is shown in greater detail in patent application U.S. Ser. No. 905,451, filed May 12, 1978, now U.S. Pat. No. 4,199,815 and U.S. patent application Ser. No. 950,242, filed Oct. 10, 1978, now U.S. Pat. No. 4,231,096, both assigned to the common assignee as this application.

A further application assigned to the common assignee and disclosing the manner in which the encoded characters are arranged for use with the electro-optical scanning system is shown in U.S. patent application Ser. No. 097,276, and filed Nov. 26, 1979.

As shown in these prior applications, the Outline is countour encoded by straight lines and the encoding of the straight line vectors start at selected points on the outline. The contiguous vectors, proceeding in a vector profile along the outline, are encoded in a digital format. The outline may start for example with the left most point of the character and proceed around the character ending at the right most point of the character. This scheme would be most preferable in a scanning device where the character was imaged by a scanning beam moving up and down, and the vector outline would be translated into beam intercept points for blanking and unblanking the beam.

The outline vectors can proceed from the top most part of the character outline and then proceed down the character with the vector profiles defining the character terminating at the bottom most point of the character. This encoding scheme would be preferable where the scanning beam is moved across the character for example from left to right and the vector outlines then define intercept points for the character outline, to properly blank and unblank the beam for character imaging.

However, in any character encoding scheme, wherein the code is written for a normalized character, the various encoded angularities formed by contiguous vectors in a outline vector profile when expanded become more pronounced and more discernible to the naked eye when the character is imaged in even larger sized characters.

In these foregoing encoding schemes or in any other contour straight line character encoding scheme, where an attempt is made to simulate a curve with a series of straight line segments, the acceptable expandable limits of the normalized character is limited by angularities in outline profiles.

While each point on the outline can be separately encoded to produce a smooth curve, the cost of such encoding would be significantly higher. Therefore, practical encoding schemes requires this aforesaid simulation of curves using straight line segments which result in insignificant outline angles in a small size character but which result in the angle becoming more and more apparent as the character size is expanded and prevents the full use of the normalized encoded character as a source of varying size characters, especially larger size characters.

SUMMARY OF THE INVENTION

The present invention provides a method and apparatus for improving the quality of an expanded size character produced by an imaging device from a normalized encoded font.

Characters are defined by encoding their outlines on a normalized grid of first and second coordinates, such as x and y coordinates, as follows:

(1) A starting point on a character outline is chosen and the first and second coordinates of this point are stored.

(2) The character outline contour is encoded by one or more straight lines which extend successively along the character outline from the start point, and closely approximate the outline. Each straight line may be coded as a vector represented by a first digital number defining the vector first coordinate distance, and second digital number defining the vector second coordinate distance from one end of the vector to the other.

This encoding scheme is conservative of space and memory. According to a preferred feature of the invention, the first and second digital numbers defining each vector are limited in size. For example, with a moderately high resolution such as 432 units to the "em" square, they may be 4-bit numbers so that a vector is represented by one byte (eight bits) of data. An analysis has shown that by far the majority of vectors required to define a character are within 15 units in the first and second coordinate directions on the grid. The vector encoding scheme also inherently provides incremental distances in both the first and second coordinate directions from the tip of the previous vector. These incremental distances can be defined with less information than the absolute coordinates of a vector end. In addition, the start point and vector data are presented in a prescribed sequence which, by itself, associates the data with specific character outlines.

Furthermore, a single set of character encoding data according to the invention is usable to generate character images in all point sizes. It is necessary only to compute the intersections between each horizontal or vertical stroke and the character outlines to determine when the CRT or laser beam should be turned on or off. The straight line vectors defined by the encoded data make it possible to carry out this computation with a minimum of hardware and software and at high speeds.

Finally, the character encoding data according to the invention may be derived automatically from raw dot matrix information or from some other digitized code in a relatively straight-forward way using a programmed digital computer. In particular, in accordance with a preferred method of encoding, the straight line vectors are chosen by first determining successive coordinate points on each outline for which the outline deviates less than a prescribed distance fromm a straight line drawn between these points. Once the outline points are determined, the first and second coordinate values of each successive point are subtracted from the first and second coordinate values of the previous point to determine the coordinate increments from point to point.

These increments are then stored as the 4-bit first and second digital numbers defining each vector.

However, the principles of the invention for smoothing a contour outline encoded set of characters may be applied to vector or non-vector encoded straight lines. For the purpose of explanation, the principles of this invention are described with regard to a vector outline coding scheme.

The manner of using the method and apparatus of this invention is more particularly described with reference to a digital typesetter producing a one-dimensional scan across the entire width of an output print medium, and with the capability of imaging the outline intersection of every character appearing across that scan line.

However, it should be understood that the principles of this invention can also be used in a device limited to scanning a single character and completing that character before proceeding onto another character and for scanning the character in any direction relative to the orientation of the character on the page.

An electronic data processing system of this aforesaid type, receives first digital data defining the identity, form, size and placement of characters to be typeset; receives second digital data defining the contour of each character to be typeset with respect to a normalized encoding set of first and second coordinates; and produces third digital data defining the character boundaries intersecting a raster (scan) line. This third digital data, for at least a portion of the raster line extending the width of several characters, is temporarily stored in a raster line storage buffer. A character imaging device, connected to the line storage buffer, is provided to image the successive raster lines on a print medium. Drive means are also provided for moving the print medium in a direction transverse to the direction of the raster (scan) line.

In a preferred embodiment of the invention, the raster line extends substantially the width of the print medium which may be at least the size of a conventional typewritten page. The print medium may comprise paper which can be used in a conventional way for paste-up or to make office copies, or the print medium may comprise a printing plate so that printed copies may be made directly from the typesetter output.

Preferably, the raster line extends horizontally on the print medium; i.e., parallel to the lines of type. An image of this raster line may be created by a scanning device, such as a laser recorder, for generating a scanning beam and a means (e.g., a mirror) for moving the scanning beam across the print medium in a scan line. Suitably, the scanning beam is switched on and off in response to the line storage buffer, as the beam is scanned across the print medium, thus forming the raster line image.

The first digital data defining the identity, form, size, and placement of the characters to be typeset may originate from a computer system (with the typesetter on line) or from a storage medium such as a floppy disk. The second digital contour data is preferably stored on a magnetic record, such as a floppy disk.

The manner in which the second digital data defines the the contour of each character of a font will be described in detail hereinbelow. Essentially, this second digital data comprises digital numbers defining the X and Y coordinates of the start points of character outlines, and digital numbers defining the length and direction of a plurality of straight lines extending successively along the character outlines from the start points. The length and direction of each straight line is represented by a vector first coordinate distance X and second coordinate distance Y from one end of the vector to the other.

In accordance with a preferred feature of the present invention, the digital numbers defining the vectors are arranged such that the vectors of an entire string are successively defined before defining the vectors of another string. In addition, the second digital data includes further digital numbers, associated with the digital numbers defining the coordinates of each start point, which constitute the starting address of the digital numbers defining the vectors of the associated string. In this way, a single vector string may be addressed from a plurality of start points within a font. Finally, it is preferable if the digital numbers defining the coordinates of a start point further specify the quadrant (either right or left) of at least the first vector of the associated, addressed vector string.

In general, character designers (persons who design character fonts) tend to create a few basic character shapes which are repeated throughout the font, either directly or in mirror image. Consistency dictates that a few shapes be repeated throughout the font while symmetry dictates that mirror images be used. The vector strings utilized in the digital definition of characters permit the quantity of data required to define an entire font to be substantially reduced because a single vector string may be addressed from the start points of various characters and may be directed to extend either toward the left or toward the right, thus forming mirror images.

The electronic data processing system used in the typesetter preferably includes a random access memory for storing fourth digital data, a data management subsystem for receiving and storing the first and second digital data and producing and storing the fourth digital data in the random access memory, and an outline coverter subsystem for receiving the fourth digital data from the random access memory and computing from this fourth digital data the third digital data defining the character boundaries intersecting the raster line. The manner in which the fourth digital data is processed and stored and thereafter converted into the third digital data is described in the aforesaid related application Ser. No. 950,242 and is not described in this application.

The principles of this invention are directed to a method and means for smoothing the outline profiles of variable size characters for display by altering a normalized encoded character data base comprising a plurality of encoded outline contours extending successively around the character outline in straight line profiles, each straight line profile having a respective start point and end point.

The method includes the steps of selecting a character and character size for display and identifying at least two encoded straight lines in a character profile at the selected size.

The method compares the angle between the straight lines to a standard and replaces the code for at least one of the said identified straight lines with the code for at least two replacement straight lines in response to said comparison, one of the replacement straight lines being continuous with the non-replaced identified outline straight lines and the non-replaced and replacement straight lines defining a smoothed outline profile.

The straight lines may be encoded by vector coordinate distances or may be encoded by any other scheme for defining the outline straight lines without departing from the principles of the invention.

The means for carrying out the principles of the invention including means for selecting a character and character size for display, means for identifying at least two encoded outline straight lines in a profile for said characters, means for comparing the angularity between said straight lines to a standard, means for replacing the code for at least one of said identified straight lines with the code for at least two replacement straight lines in response to said comparison, said non-replaced straight line and replaced straight lines defining a smoother outline profile angle.

For a better understanding of the invention, together with other and further objects, reference is made to the following description, taken in conjunction with the accompanying drawings.

BRIEF DESCRIPTION OF THE DRAWINGS

FIG. 5 is a diagram showing the normalized encoded character data contained in the Font File.

FIG. 6 is a diagram showing the structure of the outline data words contained in the Outline Data File in the Font File of FIG. 4.

DESCRIPTION OF THE PREFERRED EMBODIMENT

Figure 1:
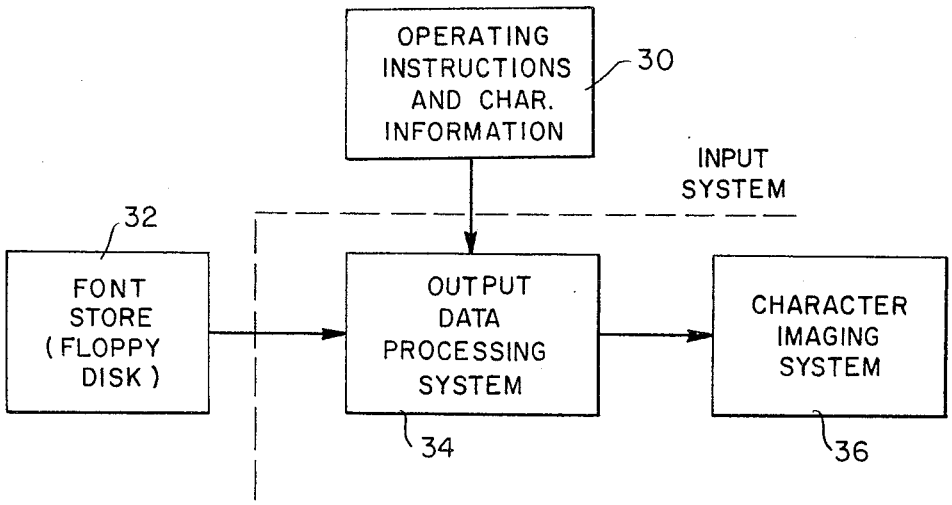
FIG. 1 is a block diagram of the overall typesetting system.

The preferred embodiment of the present invention will now be described with reference to FIG. 1 of the drawings. Identical elements shown in the various figures are labeled with the same reference numerals.

The overall system according to the present invention is shown, in block form, in FIG. 1. This general system is divided into an Input System which supplies instructions, character information and font data from separate sources 30 and 32, and an Output Data Processing System 34 which drives a Character Imaging System 36.

The input device 30 may be a paper tape or magnetic tape reader, a separate computer, an input terminal with a keyboard and CRT screen, or a data transmission channel such as a telephone line. This input device 30 supplies to the processing system 34 digital data defining the identity, form, size and placement of characters to be typeset. As used herein, the term "identity" of characters is intended to mean the name of each particular character chosen, such as upper case "A", lower case "a", upper case "B", numeral "5"; semi-colon ";" and the like. This identity is given by an ASCII or TTS code. As used herein, the term "form" is intended to designate the shape of each character; i.e., the particular font and the amount and direction of slant. The term "size", as used herein, is intended to designate the size in both the X direction ("set width") and in the Y direction ("point size") of each character. Finally, the term "placement", as used herein, is intended to mean the coordinate (X,Y) position of the character on the page to be typeset. In this particular embodiment, the input device 30 designates the X position and Y position of the upper left corner of the "em" square of at least the first character on the page. Subsequent characters are positioned in relation to the immediately preceding character if no placement information is given.

In addition to the identity, form, size, and placement of character, the input device 30 may also supply page variant information; that is, "global commands" which apply to all or a group of characters on a page. Examples of such commands are "wrong reading", which effects a left-right mirror image on the page by flipping the X positions of all characters, and "reverse video" which effects a color reversal for an entire page. For example, with reverse video a page may be imaged as white on black, rather than black on white.

Commands from the input device 30 may also effect a color reversal for a section of a page, such that only a rectilinear portion of the page is white on black rather than black on white.

The font storage unit 32 is essentially a floppy disk reader which may be a part of the input device 30. This font storage unit supplies to the Output Data Processing System 34 digital data defining the font of characters previously selected by the input device 30. This "second" digital data (as distinquished from the "first" digital data supplied by the input device 30) defines the contour of each character of a font with respect to a normalized encoded set of straight line outline profiles. The straight lines may be defined as shown by first and second coordinates. In particular, this second digital data defines the profiles or black-white boundaries of each character. If a "profile" is considered to be simply one boundary of a character, it will be seen that any "dark" portion of a character (if the character is dark on a light background) must lie between two profiles (outer boundaries or edges) of the character. By defining all the profiles of the character, with respect to a coordinate set, the "contour", outline or shape of the character is completely defined.

One aspect of this second digital data which defines the contour of each character of a font is that the character contours are defined in terms of a normalized set of outlines defined by straight lines. The straight lines may be encoded as vectors with coordinates, such as the X–Y coordinates of a Cartesian coordinate set. The term "normalized", as used herein, is intended to mean that the definition of a character in terms of the coordinate set is only related to any given absolute size or to the final size of the character when it is imaged. Thus, the digital values defining a character outline in this normalized set of coordinates are the values from which the character is scaled, up or down, to the final output resolution. Unless the scale factor just happens to equal 1 (a unique situation), the character will be defined with a different resolution than the final output.

As an example, the output data processing system 34 which will be described in detail hereinbelow is capable of scaling characters in point sizes. Notwithstanding a range of point sizes, the contour of each character is defined only once with respect to the normalized encoding set of coordinates.

The Output Data Processing System 34 receives the first digital data defining the identity, form, size and placement of characters to be typeset and the second digital data defining the contour of each character of the chosen font and produces third digital data defining the character boundaries intersecting a raster line. This third digital data is stored in one or more raster line buffers, also located within the Output Data Processing system, in readiness for the Character Imaging System 36. The raster line storage buffer(s) are preferably formed of a plurality of binary memory elements, each storing a single binary digit corresponding to a respective, unique raster point along the raster line. The line buffer(s) store sufficient raster (third digital data) for a portion of the raster line extending the width of at least several characters. In fact, the line buffer(s) preferably store sufficient data to define an entire raster line extending the complete width of the output print medium which may, for example, be at least the size of a conventional typewritten page.

The information stored in the raster line storage buffer(s) is translated into a raster line image by a Character Imaging System 36 connected to the Output Data Processing System 34. This Character Imaging System creates an image on a print medium for the particular raster line defined by the information stored in the raster line storage buffer(s). A drive mechanism is also provided in the Character Imaging System for moving the print medium in a direction transverse to the direction of the imaged raster line.

The Character Imaging System may comprise some means for creating an image for an entire raster line at once. However, the Character Imaging System preferably includes a device, such as a CRT or laser source, for generating a scanning beam and some means, such as beam deflection circuits or a movable mirror, for moving the scanning beam across the print medium in a scan line. Such one-dimensional scanners are well known.

OUTPUT DATA PROCESSING SYSTEM

General:

The Output Data Processing System, FIG. 1, is responsible for computing the horizontal coordinates, on the page to be typeset, at which the laser scanning beam must be turned on or off for each and every raster line on the page. Its computation is based upon the particular raster line which is required (depth down the page); on the particular characters (i.e., identity) which are to be set at that point on the page; and on the form and size as well as the shape of these characters as defined by the Input System 30, 32.

Since the conversion from the "second" digital data 30, defining the contour of the characters to be set, into raster data is complex, and since the raster output form requires repeated, multiple character data access, the time required for computation of each raster line becomes a significant factor in the system architecture. In an effort to minimize the computation time, the Output Data Processing System has been divided into two major subsystems:

(1) The Data Management Subsystem (DMS) and, (2) The Output Convertor Subsystem (OCS).

A Z80A microprocessor is used in the former and an 8×300 (or "SMS 300") microcontroller with a hardwired processor is used in the latter.

Figure 2:
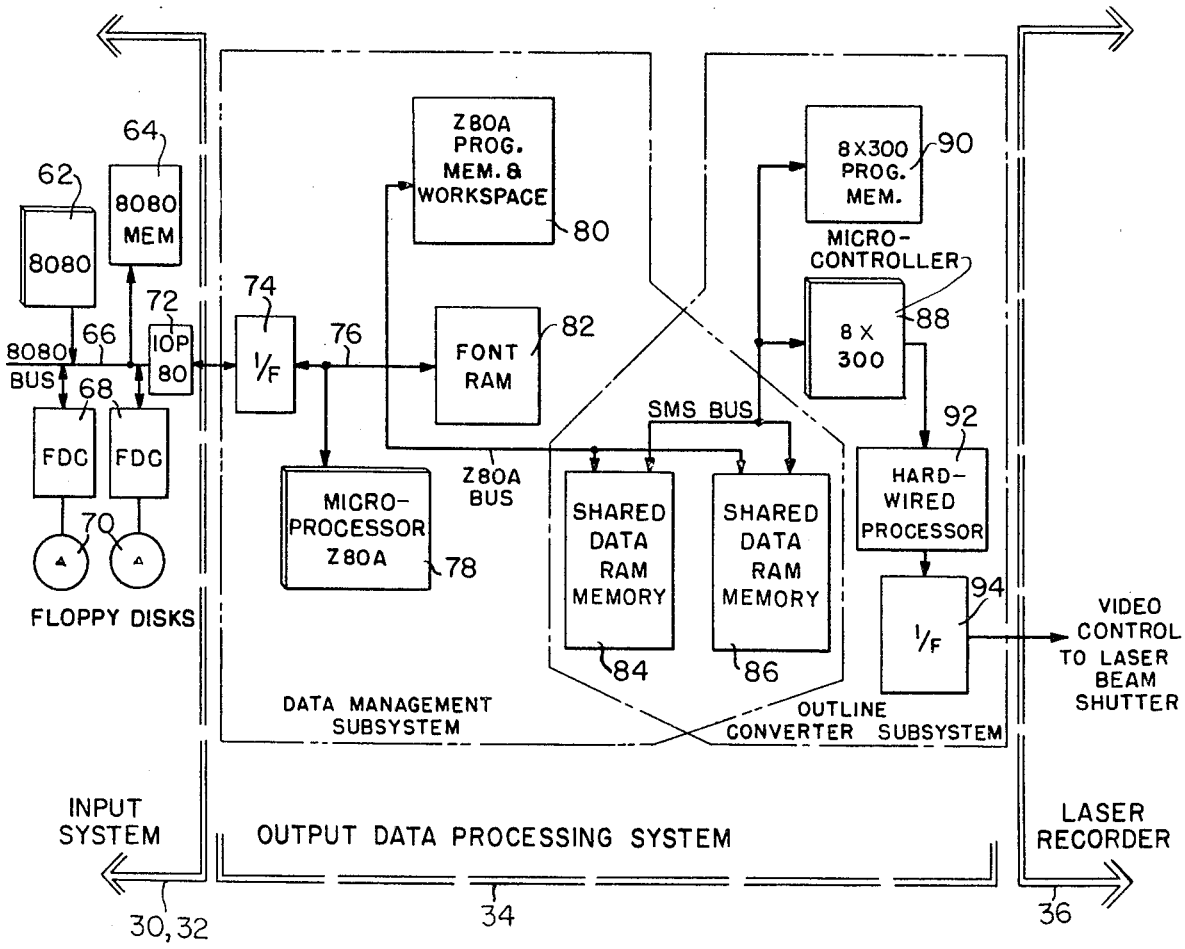
FIG. 2 is a block diagram of the Output Data Processing System in the system of FIG. 1.

FIG. 2 shows the Output Data Processing System in block form. This system receives the first digital data defining the identity, form, size and placement of the characters to be typeset as well as the second digital data defining the contour of each character from a common Input System. The Input System operates with a programmed 8080 microcomputer 62 supported by a RAM 64 of suitable size. The microcomputer and memory are arranged on a 8080 bus 66 as are two floppy disk read/write units comprising floppy disk controllers 68 and the disks 70 themselves. One disk 70 contains the text information or "first" digital data, while the other disk contains the font information or "second" digital data. The bus terminates in an IOP80 interface 72 which communicates with an interface 74 in the Output Data Processing System. This latter interface is arranged on a Z80A bus 76 as are the Z80A microprocessor 78 and four memory units 80, 82, 84 and 86 of the Data Management Subsystem.

The memory unit 80 serves to store the program for the Z80A microprocessor 78 and is a workspace for the microprocessor computations. The memory 82, called a "font RAM", stores the second digital data defining the characters of the chosen font. This data is processed and supplied in a convenient form, which will be described in detail below, to two memories 84 and 86 called "Data RAM's".

The Data RAM's 84 and 86 are "shared" by the Data Management Subsystem and the Output Converter Subsystem. Basically, the Z80A microprocessor supplies data to these RAM's and the 8×300 microcontroller 88 receives and analyzes this data, under control of a program stored in another memory 90, and supplies pertinent data to a hardwired processor 92. This hardwired processor converts the data into the so-called "third" digital data which is stored in three raster line buffers. The information contained in these buffers is then converted into a video control signal by an interface 94 and supplied to the laser recorder in synchronism with the movement of the scanning beam.

Figure 3:
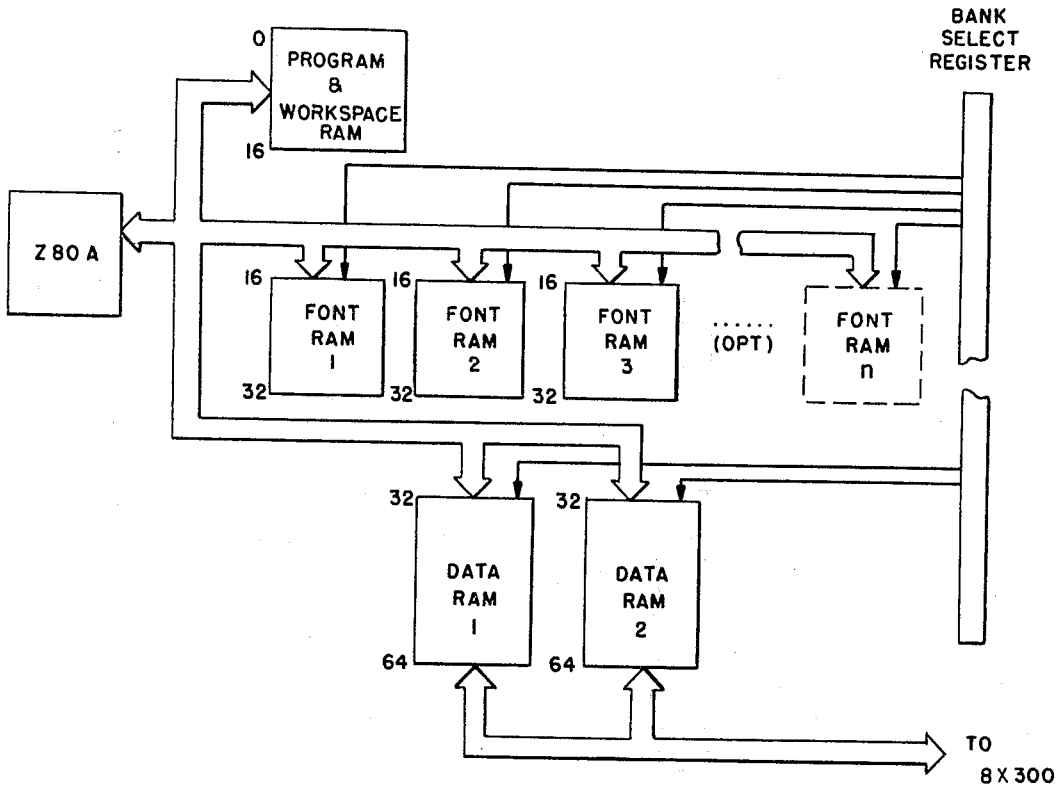
FIG. 3 is a block diagram of the Data Management Subsystem in the Output Data Processing System of FIG. 2.

Data Management Subsystem:

The circuit blocks and their interconnections employed in the Data Management Subsystem are shown in FIG. 3. In general, the responsibility of the Data Management Subsystem is to organize and supply data to the memory shared with the Outline Converter Subsystem so as to facilitate rapid processing by the Output Converter Subsystem. More specifically, the Data Management Subsystem executes the following process steps:

(a) When ready, read the next required typographical "line segments" into a Data RAM memory file from the text floppy disk.

(b) Transfer the font data from the font floppy disk to one of the font RAM memories for a "font data file".

(c) Set-up an "outline file" in the Data RAM for the Outline Converter Subsystem. This file contains the X and Y start points of each outline of each character required, as well as "vector" data defining the contour of each character.

(d) Revise the "line segments file" by replacing the character number with the location of the outline file.

(e) Repeat the above steps until no memory storage area is available for the line segments file or the outline file.

(f) Pass control to the Outline Convertor Subsystem. Restart on the other Data RAM.

The integrated circuits and interconnections forming the Outline Converter Subsystem are not shown in detail as they do not form part of the present invention. Basically, the responsibility of the Outline Converter Subsystem is to convert the outline or contour data stored in the shared Data RAM into horizontal stroke data for the later recorder. More specifically, the Outline Converter Subsystem executes the following process steps:

(a) Read the identifying data and size data for the first line segment.

(b) Read the distance from the margin to the left side bearing (LSB). Store in an X register.

(c) Read the outline start data for the next character, compute the distance from the LSB of the character to the outline. When necessary, fetch new outline vector data to update the X and Y start data.

(d) Output the sum of this value and the current X value (located in a "X" register) to the appropriate raster line buffer.

(e) Read the next outline(s); repeat step (c) until all outlines have been computed at the level on the page being set.

(f) Read distance to the LSB of the next character; add this to the X register.

(g) Repeat steps (c) through (f) until all characters in the line segment have been computed and output. Then repeat steps (a) through (f) for all other line segments on this level.

(h) When all line segments on this level have been computed, transfer control of the raster line buffer(s) to the laser drive system, and start storing data in an alternate (next) raster buffer for the raster line 1/10th point down the page. The outline converter system showing how the encoded character data is converted to stroke data is shown in greater detail in the cross related application.

FONT DATA DESCRIPTION

General:

The second digital data defining the characters of each desired font is stored on the font floppy disk 32. This data is of the "outline" type; that is, it defines the contour of each character with respect to a normalized encoded set of coordinates. In order to compress data, not all the character outline points on the resolution matrix are encoded. The general nature of the encoding scheme is described in the above-referenced, commonly-owned U.S. patent application Ser. No. 905,451, filed May 12, 1978, of Derek Kyte, et al. and entitled "Character Generating Method and Apparatus".

Figure 4:
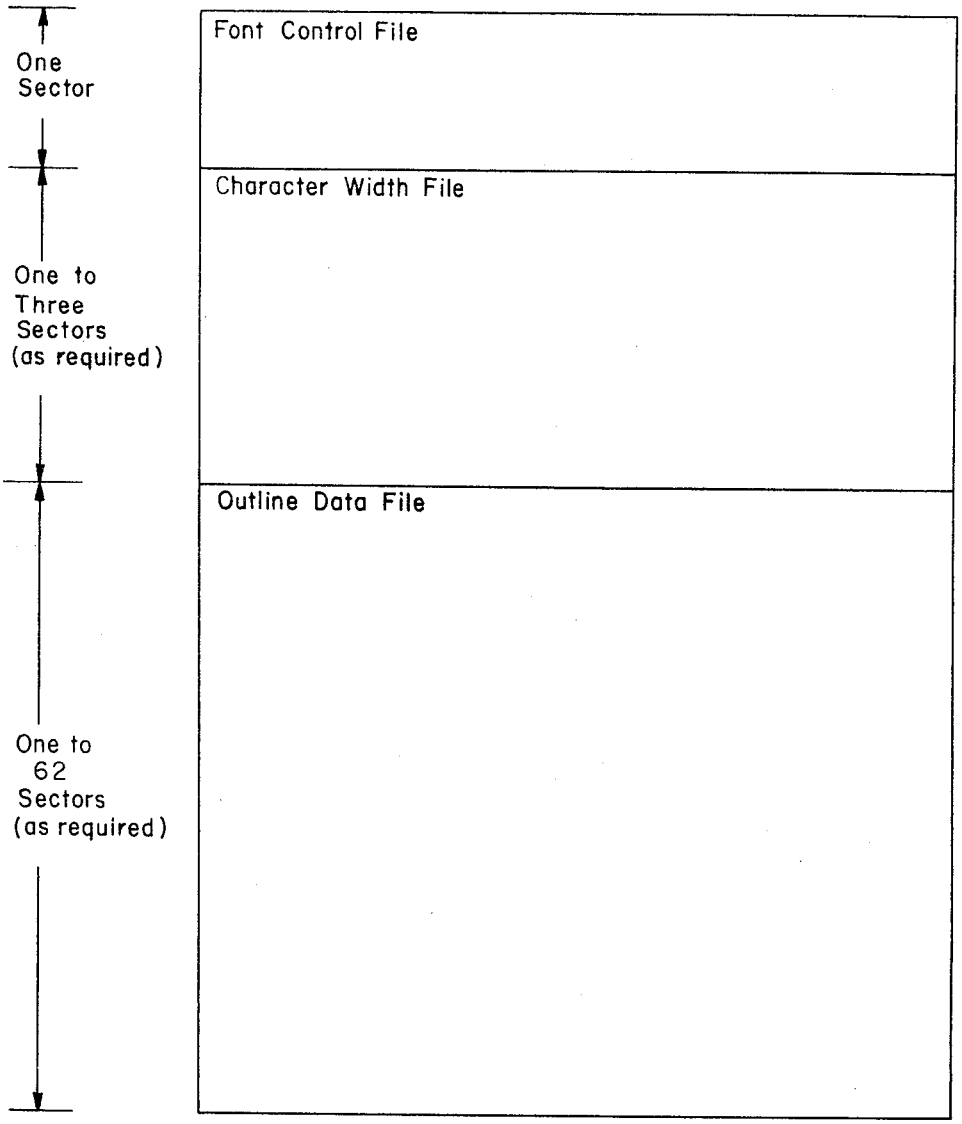
FIG. 4 is a diagram showing the structure of the Font File contained in the font storage unit in the system of FIG. 1.

Because the floppy disk is the principal storage medium for fonts, the font data has been structured to correspond to the size of the sectors of the disk. Three separate subfiles comprise a font file as illustrated in FIG. 4:

1. Font Control File;
2. Character width File; and
3. Outline Data File.

The font Control File contains all the data which describes the font as an entity, such as a font description, serial number, number of characters, base jump and fixed space data, etc. This file is totally contained in one floppy disk section (125 words).

The Character Width File contains the width of each character and other character-related data required by the Input System. This file is contained on one or more full sectors, depending upon the number of characters per font.

The Outline Data File contains the starting coordinates of character outlines, the vectors that define the shape of the outlines, character control words and file size controls. This file is contained on one or more full sectors, depending upon the number of characters and the shape complexity of the characters.

When the Data Management Subsystem (DMS) requires font data, the appropriate font data is read from the floppy disk by the Input System and transferred to Font RAM 82 by the DMS.

Character Definitions:

All characters are digitally encoded or "digitized" for an outline, relative vector decoding system, where all character outlines are assumed to be closely approximated by straight line elements. Such a system is disclosed in the commonly-owned U.S. patent application Ser. No. 905,451, referred to above.

All characters are defined as a multiple series of "curves". In the preferred embodiment shown for explanation, each curve describes a vertical outline edge with the following components:

(a) An X, Y coordinate defining the highest point of the curve within an em square;

(b) A white-to-black or black-to-white bound;

(c) A series of straight line segments, defined by a series of data bytes which define the slope and length of each segment of the curve; and (d) Vector direction (downward and left-to-right or right-to-left) of the segments.

Defining the character consists of listing all the curves which outline the character. They are listed in descending order; that is, the curves that start at the top of the character are listed first and the bottom last.

Scale:

The principal unit of measurement is the Data Resolution Unit (DRU) which is defined as 1/432 of the traditional em. An extended em square is 576×576 DRU's.

Position 0.0 is located at the intersection of the left side bearing (LSB) and the top of the extended em square as illustrated in FIG. 5. Therefore, X (left-right) values can be positive (positive is right) or negative (if a character bound extends to the left of the left side bearing (LSB), but Y (up-down) values will always be positive (positive is down).

Outline Data Words:

Each outline will be defined by 3 or more data words: a Y word, an X word, and one or more outline (vector/-control) bytes. The format of these data words is shown in FIG. 6. The various parts of the coding shown in FIG. 6 are specified below:

Y Data Word Components:

Yn—This data defines the vertical position of a start point from the upper edge of the extended em.

30K—Undefined.

X Data Word Components:

Xn—This data defines the horizontal position of a start point. The left side bearing (LSB) is defined as 0.

35X Sign—The sign bit defines the displacement direction of Xn with respect to the LSB.

L Bit—The L Bit defines the direction of the dx of the first vector. A one defines a left pointing vector, a zero defines right pointing.

F Bit—The F Bit or "Flare Bit" defines which vector slope will be used by the decoder in extrapolating the character outline in the region of the grid immediately above the line Yn.

E Bit—The E Bit or "Extrapolation Bit" defines whether extrapolation is or is not used above the start point grid line Yn.

B Bit—The B Bit is the "Boundary On/Off Bit" and defines whether the outline is a left-side (on) boundary or a right-side (off) boundary.

Vectors/Controls Data Byte Components:

Vectors:

dydx—For all values of dy greater than 0, this byte defines the slope of the vector outline of the character from the start point (Xn Yn), or from the last vector end point. All vectors are sequenced serially in the same sequence that they occur on the character outline.

Controls:

For all values of dy=0, this byte defines a control code. The specific control is dependent upon the value of dx (in hexadecimal notation) as indicated below:

0,0—End of outline.

0,1—Reverse the dx direction for the next vector.

0,2—Defines that there are no displacement vectors applicable to the start point defined by the preceding Y and X Data Words. This control is always followed by a zero byte to produce an "End of Outline" control code.

0,3—Defines the vector with a horizontal displacement of 0 DRU's (a vertical vector) and a vertical displacement greater than 30 DRU's. The next data byte defines the binary value of the vertical displacement. The data byte has a resultant range of vertical displacements of 0 to 255 inclusive, but it is not utilized between 0 and 30 inclusive. (Example: The two bytes 0/3, 2/6 describe a composite vector that goes vertically down 38 DRU's.)

0,4—Defines a vector with a horizontal displacement of 1 DRU and a vertical displacement of 30 DRU's.

0,5—Defines a vector with a horizontal displacement of 1 DRU and a vertical displacement of 120 DRU's.

0,7 through

0,C—Undefined

0,D—Defines a rectilinear outline change with a vertical displacement of 1 DRU and a horizontal displacement of up to 255 DRU's. The next data byte defines the binary value of the horizontal displacement. (Example: The two bytes 0/D, 2/6 describe an outline made up of 1 DRU vertical and a 38 DRU horizontal displacement.)

0,E—Defines a rectilinear outline change with a vertical displacement of 1 DRU and a horizontal displacement greater than 255 DRU's. The next data byte defines the binary value of the horizontal displacement in excess of 256. (Example: The two bytes 0/E, 2/6 describe an outline made up of a 1 DRU vertical and a 294 DRU horizontal displacement.)

0,F—Defines a shallow slope vector with a vertical displacement of 1 DRU and a horizontal displacement greater than 15 DRU's. The next data byte defines the binary value of the horizontal displacement. (Example: The two bytes 0/F, 2/6 describe a composite vector that goes over 38 horizontal DRU's and down one DRU.)

Figure 7:
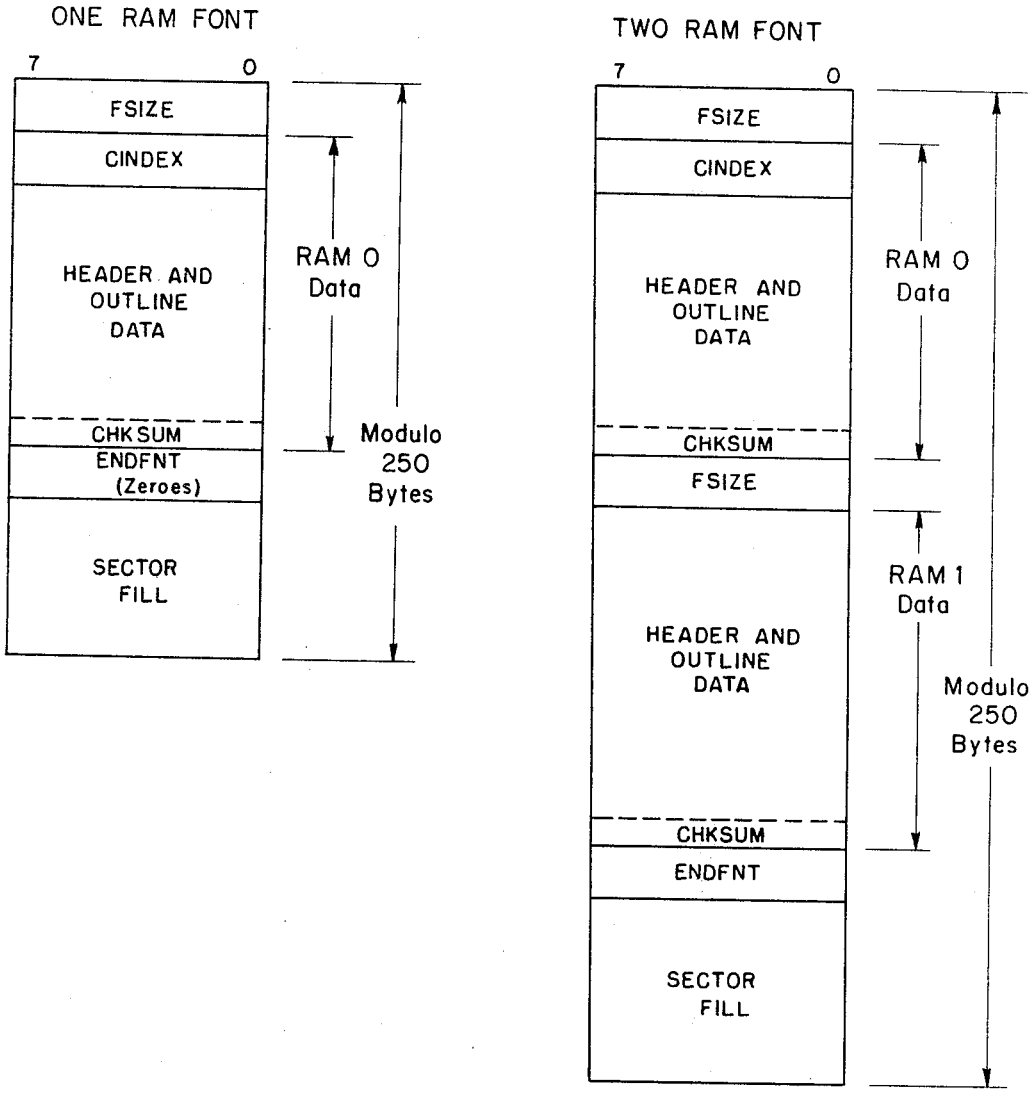
FIG. 7 is a diagram showing how the Outline Data File is arranged on a data storage medium such as a diskette.

Outline Data File Structure:

The Outline Data File resides on the font floppy disk, and stores a memory image of the data that will be loaded into one or more Font RAMs. The file occupies one or more sectors on the disk, and accordingly it is modulo 125 words long. FIG. 7 illustrates the file structure.

If the total font outline data is less than 16,384 bytes, then the Outline Data File will contain:

1. FSIZE word (No. of bytes in RAM)
2a. CINDEX (Character Index)
2b. Header and Outline Data
3. ENDFNT (Zero word)
4. Sector filler Items *2a* and *2b* comprise the RAM memory image, and may not exceed 16,384 bytes.

If the total font outline data exceeds 16K bytes, the File will contain:

1. FSIZE word
2ab. CINDEX, Header and Outline Data (16,384 bytes max.)
3. FSIZE word (No. of Bytes in next RAM)
4. Header and Outline Data (16,384 bytes max.)
5. ENDFNT
6. Sector filler Items 3 and 4 may be repeated as required if the total font outline data exceeds 32,768 or 49,152 bytes. The data will occupy the Font RAM beginning at address "4000 and may fill through to address "7FFF (where the initial quotation mark (") indicates a hexidecimal number. Addresses in the headers will be absolute; addresses in in the CINDEX will be offset absolute ("0000 through "3FFF) with the two MSB's flagging multi-RAM locations.

The specific contents of the Outline Data File are as follows:

FSIZE:

This word defines in binary the number of bytes to be loaded into a Font RAM. The count does not include the FSIZE word or the ENDFNT word. The count for the first Font RAM includes the entire CINDEX and all header and outline data.

CINDEX:

The character index is variable length and consists of a character count (CCOUNT) and a relative addressed index.

The CCOUNT is one byte defining in binary the number of characters in the font, and therefore it also defines the word length of the index. It will be a number between 1 and 255 inclusive. The RAM address location of CCOUNT is "4000.

The index contains a one word entry for each character in the font. Each entry is the offset absolute address of the YCOUNT byte for the character. The two most significant bits of word indicate in binary the RAM that contains the character, where 00 is the RAM that contains the index. The 14 least significant bits contain the offset RAM address (the absolute RAM address less "4000) of the YCOUNT byte of the character.

The first entry in the index is by definition character number 1 and must correspond with the first character width group in the Character Width File. Character numbers proceed sequentially by implication (there are no expressed character numbers or library numbers at any location in the font).

ENDFNT:

This word defines the end of all font data and consists of 2 bytes of zeros.

Sector Filler:

Zero data is used to fill through to the end of the floppy disk sector that contains the ENDFNT word.

Figure 8:
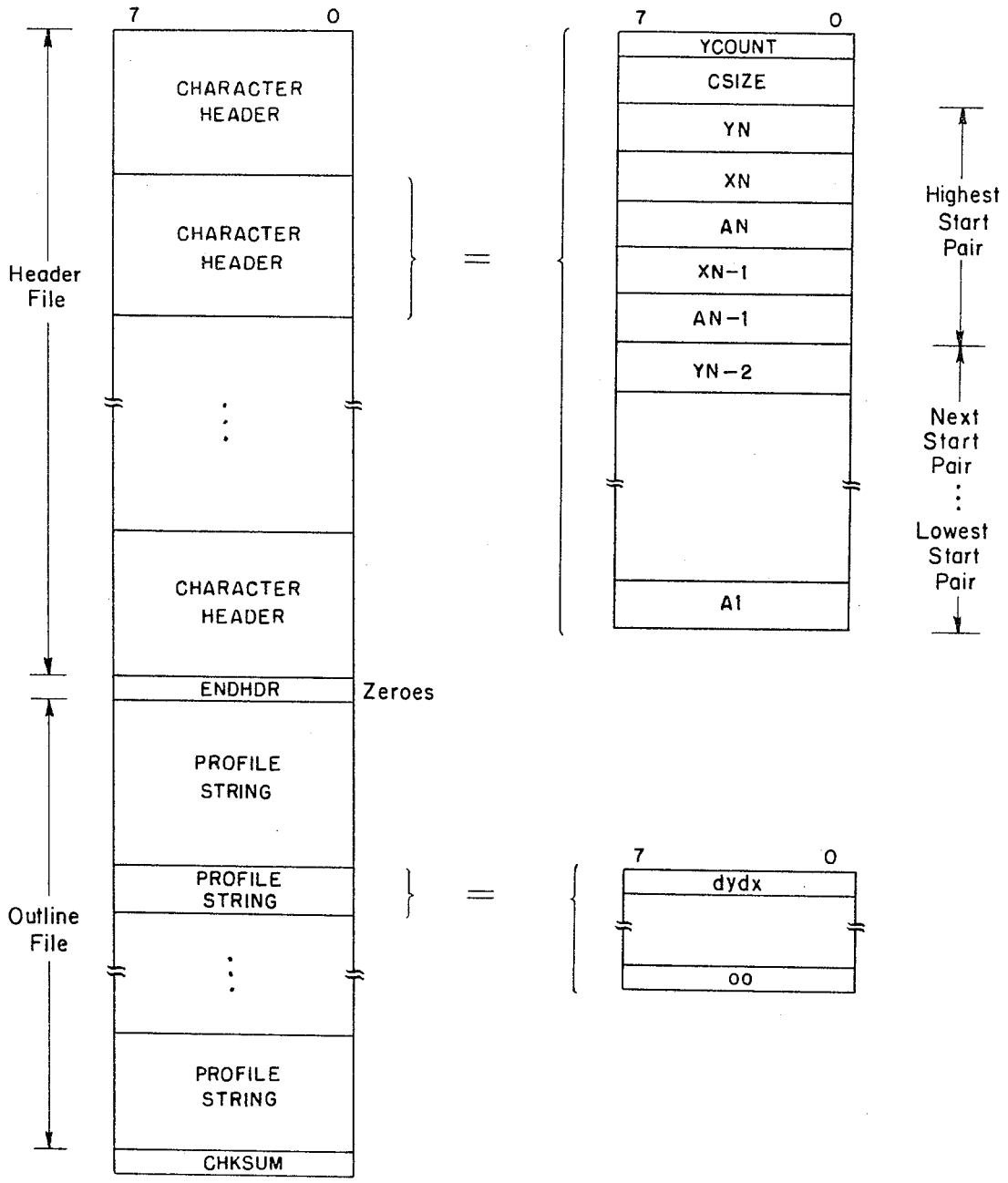
FIG. 8 is a diagram showing the structure of the header and outline data contained in the Outline Data File of FIG. 7.

Header and Outline Data:

The header and outline data in each RAM contains all of the character digitization data pertaining to each of the characters located within that RAM. The X and Y start locations for characters are listed in the Header File; the vectors and control bytes that define the profiles of characters are listed in the Outline File. The two files are separated by a zero data byte (ENDHDR). FIG. 8 illustrates the file structure of the Header and Outline Data.

A checksum byte follows the Outline File and immediately precedes the ENDFNT word or the FSIZE word that separates RAMs.

Header File:

The Header File consists of a series of character headers, one for each character in the font. There is no space between headers. Each character header contains (in sequence and without space) a YCOUNT byte, a CSIZE word, and one or more start-pair sets of data words (one set for each pair of starts).

YCOUNT:

The YCOUNT byte defines in binary the number of YN entries in the header, which is the same as the number of start pairs. The length in each character header is ten times the YCOUNT plus 3 bytes.

CSIZE:

The CSIZE word defines in binary the total amount of data space in bytes that the character fills when loaded once into the Data RAM. Accordingly, it is equal to twelve times the YCOUNT plus the length of all the profile strings addresses within the start-pair data sets.

START-PAIR DATA:

YN is the Y Data Word and XN is the X Data Word as defined, N must be even, since outlines always start in pairs. AN is the absolute address of the initial byte of the profile string of vectors and controls that define each outline shape. Each address will be a number between "4000" and "7FFF. Addresses may be duplicated within the header file in the event that a profile string is shared (the character outline shape is common) for more than one start point. An address may not point to a profile string located in another RAM. The YN, XN, and AN Data Words are sequenced as shown in FIG. 8 and listed without space. Each Each successive YN value is equal to or larger than the preceding YN value.

Outline File:

The Outline File consists of a series of profile strings. Each profile string is a sequential series of two or more Vectors/Controls Data Bytes. Each string defines a unique vertical character outline and begins at the header start point. A string is terminated by control 0 (end of outline), which is a zero data byte. Filler bytes may not be used within a string; they are permissible before or after any string. The digitization program(s) avoids duplication of identical profile strings, and minimizes the number of RAMS a font used by sharing profile strings for character outlines that closely approximate each other.

CHKSUM:

A one byte checksum verifies each complete RAM; it is formed with all of the data in the Font-RAM except the CHKSUM byte itself. The checksum shall be formed by initializing to zero; then, for each byte, the checksum is rotated right one bit (LSB becomes MSB) and the data byte is added to form the new checksum. Overflow on the addition is ignored. The final 8 bit checksum is defined as CHKSUM and is entered after the last data byte.

Profile Strings:

In general, the profile strings in the Outline Data File are separated from the start points (YN and XN) to permit several start points to reference (address) the same profile string. In this way, different characters within the same font having, as a part thereof, the same basic shape may be defined by the same data, thus achieving data compression.

For example, the following letters may have the identical contour on their left-hand side: "o", "c", and "e". The Outline Data File will thus contain two profile strings defining the inner and outer boundaries on the left-hand sides of these characters. The highest pair of start points in the character header for the "o", "c" and "e", respectively, may therefore address these two profile strings.

Because the dx values in the profile strings may be either positive or negative, depending upon the "L bit" in the X data word (XN), a single profile string can serve for various characters which are symmetrical. For example, portions of the character "b" may be summetrical with the character "d" and portions of the character "p" may be symmetrical with the character "q". Such characters may be defined with the same profile strings which are directed by the "L bit" to move in opposite directions.

In general, character designers (persons who design character fonts) tend to create a few basic character shapes which are repeated throughout the font, either directly or in mirror image. Consistency dictates that a few shapes be repeated throughout the font; symmetry dictates that mirror images be used. The profile strings utilized in the digital definition of characters in the present system are a useful tool in recreating these basic character shape. Because the endocing scheme permits the addressing of a single profile string from the start points of various characters, and permits the dx increments in a profile string to have positive or negative values, the quantity of data required to define an entire font is substantially reduced.

Miscellaneous:

Within the definition of a single character, there is no restriction on starting two outlines (profile strings) from the same point. There is also no restriction on ending two outlines at the same point. Two outlines may touch, but they may not cross over each other if they change from "on" outlines to "off" outlines.

Broken characters are also permissible in the Outline Data File. There is no restriction on broken (divided, separated) characters.

Font RAM Format:

The DMS utilizes RAM memory to contain the font data for the font(s) to be typeset on the page in order to have high-speed access to this data. The data for the font is supplied to the DMS by the Input System where it is stored on the System Floppy Disk (SFD).

A complete font is stored on one or more Font RAMs, each Font RAM storing no more than one font at a time.

The DMS can contain one to eight Font RAMS. The system will function with only one Font RAM, provided that one Font RAM size fonts are used. Multiple Font RAMS ensure against degradation in throughput speed on pages with font mixing.

Each Font RAM is 16K bytes; each Font RAM card can contain up to 64K bytes of memory: the equivalent of 4 Font RAMS. Units of less than four fonts can be accomplished by depopulating the Font RAM cards in 16K byte increments.

At system reset, the DMS determines which Font RAMS are available for loading by writing a pattern into each RAM location and reading back the results. Any mismatch is recorded as an inactive font position in a font table. After testing each of the eight locations, a message is sent to the Input System defining the number of active Font RAMS; this can be utilized to detect defective RAMS. The font table is used later to record the font numbers stored in each RAM.

In the process of developing a Data RAM, the DMS copies specific character outline data from the Font RAM into the outline file in the Data RAM. If a font change occurs, the DMS will search the table of font numbers loaded. If the font is not already loaded, the DMS will load the new font into the first empty Font RAM(s). If all Font RAMS are in use, the RAM or RAMs least recently used are overwritten with the new font needed.

The data stored in the font RAM is identical in content and structure to the Outline Data File font data on the Input System floppy disk.

In addition to the font data stored on the Font RAM card(s), the DMS maintains two additional tables per font in the program workspace that are used to regulate data transfer from Font RAM to Data RAM: an In-Seg Table and an In-RAM Table. These are described below. In-RAM Table:

This 512 byte table contains the address within the Data RAM where a character header has been stored. The table is ordered in accordance with the character numbers. Each entry is two bytes. A zero entry indicates that the character data has not been loaded.

Whenever a new character is put into the Data RAM, the corresponding 2 bytes in this table are loaded with the Data RAM address. This table is cleared at the start of building each new Data RAM.

In-Seg Table:

This 32 byte table is used to indicate which characters of the font have already been encountered within the line segment currently being developed in the Data RAM. Whenever an address is loaded into the In-RAM Table, a bit is correspondingly set in this table. This table is cleared at the start of each new set level (YSL).

In structure, each bit corresponds to a character number between 0 and 255 inclusive. The address of the bit is computed by:

Char. Number $$8 = Q + R \text{ (Quotient integer and Remainder integer)}$$

where Q is the byte in the table and R is the bit within the byte.

PAGE DATA DESCRIPTION

Page Definition:

A page position is defined by X, Y coordinates in 1/10 pts. This is called a raster resolution unit (RRU). The top left hand corner is position 0,0. The maximum page size is 11"×17". That is 7954×12,292 RRU. Movement in a page can only be from top to bottom.

The raster position being solved for at any time is called the Y set level (YSL). This value initially starts at 0 and is incremented by one until it reaches the maximum page depth.

Page Variants:

In addition to the normal standard page form, five full page variants have been incorporated in the ODS design. All variants are mutually exclusive.

High Resolution:

A high resolution laser recorder can have its drum drive gear ratio altered so that each step of the stepper motor 58 drives the drum 56 by 1/20th pt., a high resolution RRU (HRRRU). Horizontal (x) resolution is not increased.

The ODS has a chip switch on the DMS (Z80A) microprocessor which is set for this laser recorder. The DMS halves the Ys, and the OCS increments the set level on every other raster output.

Proof Page:

A laser recorder with proof page capability would make 2 stepper motor steps between each raster line, effectively doubling the speed of page setting with proof quality.

The command for proof page will be entered from the Input System. The DMS will set the Ys level depending upon whether the laser recorder is a normal or a high resolution unit, and the OCS will accordingly increment the set level by one or two on each raster output.

Page Width:

The laser recorder will have either an 8½" or a 11" wide drum 56.

The ODS has a chip switch on the DMS (Z80A) microprocessor which is set for 8½" or 11". The DMS uses an appropriate page width when page complementing the XPOS value for wrong reading output.

Wrong Reading:

Any page can be output from any type of laser recorder in right reading or wrong reading (mirror image).

Selection of wrong reading is made by a toggle switch on the DMS (Z80A) microprocessor. The DMS page complements the XPOS location of every character, and complements the X position of every outline on each character and the direction that each outline moves.

Reverse Video:

Any page can be output white-on-black or black-on-white (reversed normal).

Selection of reverse video is made by toggle switch on the hardwired processor (HWP). The HWP inverts the polarity of the raster.

Line Rule:

Line rule is similar to reverse video, except that an entire line (white-on-black or black-on-white) of defined length becomes a single solid color. This command permits generation of line rules on the page.

INPUT SYSTEM INTERFACE SPECIFICATION

General:

This specification sets forth the required data and data format to be transmitted between the Input System and the Output Processing system. The transmissions are made through the Input System IOP-80 on a handshake basis of a byte serial transfer. Table 1 summarizes all the interface transmissions to the ODP System.

TABLE 1

SUMMARY OF INTERFACE TRANSMISSIONS

| | INPUTS TO ODP SYSTEM FROM INPUT SYSTEM |
|---|---|
| CONTROL TRANSMISSIONS 8 BIT BYTE & CTL = 1 | NEW PAGE READY<br>RESTART REQUEST<br>RESET REQUEST<br>PROOF PAGE<br>START PROG STORE<br>PROG STORE FAULT |
| DATA TRANSMISSIONS 16 BITS (TWO BYTES) & CTL = 0 | PROGRAM DATA<br>PAGE DATA<br>FONT DATA |

Page Data:

The Output Data Processing System is a page output machine, principally because the laser recorder must expend the time required to expose a full raster even if it only had data for part of a raster. Therefore the throughput of the machine is enhanced significantly by supplying the laser recorder with all of the graphic data needed in each full raster prior to exposing the raster. This requires storing and regrouping random sequence input data into a top down sequence. Due to memory size limitations in the Output Data Processing System, the data must be further packeted into groups defined as "line segments", which is the standard unit of page data to be transmitted by the Input System.

Font Data:

The Input System stores digital outline fonts on floppy disks in the manner described above. The outline data is required in the solution of the raster on-off points, and this data is transmitted by the Input System on a whole font basis (excluding width data, BLJ data, etc.).

Other Data:

The Input System stores digital outline fonts on floppy disks in the manner described above. The outline data is required in the solution of the raster on-off points, and this data is transmitted by the Input System on a whole font basis (excluding width data, BLJ data, etc.).

Other Data:

In addition to the above job related data, periodic data transfers may be made by the input System, if desired. These include programs, error messages, restart and program reset. The power-on reset signal may also originate in the Input System.

Notation:

Meta-Language notation will be used to describe the syntax of the data requirements. The following notation will be used:

"" Terminal—a fixed bit length symbol element (e.g.: all page data elements are 16 bit words).

() Non-Terminal—A higher order language element which is composed of one or more terminals and/or one or more non-terminals.

[] Optional Repeats—The braces indicate that the enclosed non-terminal(s) may be not used or used as often as desired.

/ Either-Or—A slash indicates that the non-terminals on either side of the slash are possible alternative elements.

* Once only—An asterisk is used to indicate that the non-terminal may not be used more than once within the complex non-terminal being defined.

PAGE DATA

Page Data Structure:

As outlined in section above, coded data which describes a page must be packeted into groups defined as "line segments":

(PAGE)=[(LINE SEG)]"END PAGE"

Each page can consist of one or more line segments followed by an end page code. A blank page has no line segments. The end page code is a terminating code, and no data relating to the page can be accepted after the code. All functional data received prior to the end page code is not carried over into the next page, and must be repeated as needed.

Each line segment defines a character set, a reverse video set, and/or a line rule set:

(LINE SEG)=(SEG#)*(YPOS)*[(CHAR SET)/(RVSET)/LR SET)]"END SEG"

The first element in each line segment is the segment number. Separate line segments with unique segment numbers must be defined for each character set with a unique YPOS and point size combination. Separate line segments should preferably be defined for each reverse video or line rule set, and also preferably for a set that is not contained within the Y limits of the extended em square of a character set. All reverse video or line rule sets within a single line segment must have the same YPOS value.

The segment number is followed by YPOS, which nominally is the Y coordinate on the page of the top of the extended em square of the characters in the line segment and/or the upper coordinate of the reverse video or line rule set(s) in the line segment. All the line segments on the page must be sequenced in the order of the YPOS coordinate; there is no sequence requirement between line segments with the same YPOS coordinate.

The line segment can contain one or more character sets, and/or one or more reverse video and/or line rule sets.

The end segment code is a terminating code, and no data relating to the segment can be accepted after the code. All functional data received prior to the end segment code is not carried over to the next segment, and must be repeated as needed.

Character Sets:

All character sets within a line segment must follow the structure:

(CHAR SET)=(INITIAL CHAR)[(CHAR PAIR)]

with one initial character followed by one or more character pairs. The initial character must follow the structure:

(INITIAL CHAR)=(PT SIZE)*(FONT)(XPOS)(CHAR PAIR)

The initial character in a line segment must contain a size, a font number, the x coordinate of the character's left side bearing (XPOS), and the character pair data which is structured:

(CHAR PAIR)=[(FUNCTION)]"CHAR"

and where permissible functions are:

(FUNCTION)=(XPOS)/(FONT)/(SET WIDTH)/(SLANT)/(BLJ)/(YLOW)

The character code is partially a terminating code, that is, although no functions relating to a particular character can be accepted after the code, all functional data received prior to the code is carried over and remains valid until altered by a new function code or a line segment terminating code (END SEG).

All latest function codes are valid in this manner until altered except YLOW, which can only be altered by the issuance of a numerically higher valued YLOW.

Within a character set, an initial character must precede any follow-on character pairs. All other functional codes may be sequenced randomly, subject only to the restrictions described above.

Reverse Video Sets:

All reverse video sets within a line segment must follow the structure:

(RV SET)=(XPOS)(RV CODE)(YEND)(XEND)

The elements of the reverse video set must be sequenced in the above order with no intervening elements.

Line Rule Sets:

All line rule sets within a line segment must follow the structure:

(LR SET)=(XPOS)(LR CODE)(YEND)(XEND)

The elements of the line rule set must be sequenced in the above order with no intervening elements.

Table 2 summarizes the syntax of the page data structure:

TABLE 2

| PAGE DATA SYNTAX |
|---|
| (PAGE) = [(LINE SEQ)] "END PAGE" |
| (LINE SEG) = (SEG#)* (YPOS)*[(CHAR SET)/(RV SET)/ |

TABLE 2-continued

| PAGE DATA SYNTAX |
|---|
| (LR SET)] "END SEG" |
| (CHAR SET) = (INITIAL CHAR) [(CHAR PAIR)] |
| (INITIAL CHAR) = (PT SIZE)*(FONT) (XPOS) (CHAR PAIR) |
| (CHAR PAIR) = [(FUNCTION] "CHAR" |
| (FUNCTION) = (XPOS)/(FONT)/(SET WIDTH/(SLANT)/ (BLJ)/(YLOW) |
| (RV SET) = (XPOS) (RV CODE) (YEND) (XEND) |
| (LR SET) = (XPOS) (LR CODE) (YEND) XEND) |

Input Codes/Terminal Elements:

Table 3 summarizes the input code structure for those terminal elements which are to be sent from the Input System to the Output Data Processing System, with references to the following descriptions of the terminal elements used in the syntax the "Page Data Structure".

(SEG#)="SEG#"

This is a 13 bit number (the LSB's of the 16 bit field, the 3 MSB's shall be 0's) unique to each line segment in the page. It is the number used to identify each line segment, and will be used by the Output Data Processing System when it needs to call for a specific line segment. It must be the first code of every line segment, and may not be issued more than once in any line segment.

Segment numbers may be any number between 1 and 8191 inclusive (not zero), and it is not required that the segment numbers be sequenced with increasing YPOS values.

(YPOS)="YPOS"

This is the Y coordinate on the page in RRU's of the top of the extended em square of the characters in the line segment and/or the upper coordinate of the reverse video set in the line segment. The top of the page (which is nominally below the top of the sheet of paper) is defined as 0 RRU's. Up to 14 bits are available to describe YPOS values between 0 and 12,292 RRU's (17 inches).

The LSB of the YPOS corresponds with the LSB of the input word. This code nominally follows the segment number, and is only issued once within a line segment.

(XPOS)="XPOS"

This is the X coordinate on the page in RRU's of the left side bearing of the character or of the reverse video coordinate that pairs with the YPOS RV coordinate. The left hand edge of the sheet of paper and the page is defined as 0. Normal margin offsets are controlled by Input System programs. Up to 14 bits are available to describe XPOS values between 0 and 7 and 7,954 RRU's (11 inches). The LSB of XPOS corresponds with the LSB of the input word.

TABLE 3

16 BIT INPUT CODE FORMAT

| 15 | 14 | 13 | 12 | 11 | 10 | 9 | 8 | 7 | 6 | 5 | 4 | 3 | 2 | 1 | |
|---|---|---|---|---|---|---|---|---|---|---|---|---|---|---|---|
| SEG# | | | | | | | | | | | | | | | |
| 0 | 0 | YLOW data in RRU's | | | | | | | | | | | | | |
| 0 | 1 | YPOS data in RRU's | | | | | | | | | | | | | |
| 1 | 0 | XPOS data in RRU's | | | | | | | | | | | | | |
| 1 | 1 | 0 | 0 | 0 | 0 | CHAR number | | | | | | | | | |
| 1 | 1 | 0 | 0 | 0 | 1 | FONT number | | | | | | | | | |
| 1 | 1 | 0 | 0 | 1 | 0 | PT SIZE in ½ pts | | | | | | | | | |

TABLE 3-continued

| | | | 16 BIT INPUT CODE FORMAT | | | |
|---|---|---|---|---|---|---|
| 1 | 1 | 0 | 0 | 1 | 1 | SETWIDTH in ± ⅛ pts |
| 1 | 1 | 0 | 1 | 0 | 0 | LR CODE |
| 1 | 1 | 0 | 1 | 0 | 1 | SLANT |
| 1 | 1 | 0 | 1 | 1 | 0 | RV CODE |
| 1 | 1 | 0 | 1 | 1 | 1 | END SEG |
| 1 | 1 | 1 | 0 | 0 | 0 | END PAGE |

(YLOW)="YLOW"

This is the Y coordinate on the page in RRU's of the bottom of the extended em square of the characters in the line segment. It is not necessary that this value be supplied for line segments with average characters; i.e., characters that fall within the extended em square. It must be supplied for logo's that do extend lower than the extended em.

The Input System derives the value from the font data and the point size that the logo is being set at. If this code is issued more than once, the highest value (lowest point on page) is retained by the Output Data Processing System. Scaling, zero placement, and data placement are identical to YPOS.

(FONT)="FONT"

This terminal code defines the font number to be used for all characters following until a new font is input. Up to 10 bits are available to input font numbers between 1 and 254 inclusive. The font number LSB corresponds to the word LSB.

This terminal code defines the point size to be used for all characters in the line segment. It may only be issued once within a line segment. Up to 10 bits are available to input all half point sizes between ½ and 130 inclusive. The word LSB corresponds to ½ point, and bits 1 thru 8 define the binary value of the point size directly.

This terminal code defines the set width to be used for all characters following until a new set width is input. If this code is not issued, the set width has a default value equal to the point size of the line segment being set. The set width command(s) must follow the point size commands.

This terminal code defines that the immediately following 2 words represent the YEND and XEND respectively in a line rule set in which YPOS and XPOS preceding are the beginning coordinates. The 10 LSB's of the input code are zero.

This terminal code defines the slant amount to be used for all characters following in the line segment until a new slant is input. Up to 10 bits are available to define 5 possible slant conditions; value 0 corresponds to SLANT OFF, value 1 to SLANT +7, value 2 to SLANT +14, value 3 to SLANT −7, and value 4 to SLANT −14.

(RV CODE)="RV CODE"

This terminal code defines the end of a line segment, and sets all variable functions contained within that segment to the default value. The 10 LSB's are all zero.

This terminal code defines the end of a page, and sets all variable functions to the default value. The 10 LSB's are all zero.

This code must be preceded by a line segment which contains a YLOW value equal to the depth of the page. This may be done by either:

(1) Defining a YLOW equal to the page depth within the last line segment of the page; or (2) Defining an additional line segment with the content:

(SEG#)(YPOS)(YLOW)"END SEG", where YPOS and YLOW equal to the page depth, or with the content:

(SEG#)(YPOS)"END SEG", where YPOS equals the page depth.

FONT DATA

Font Data Structure:

Coded data which describes the outlines of characters in a font will be transmitted from the Input System to the Output Data Processing System on a whole font basis:

(FONT)=[(CHAR OUTLINE DATA)]"END FONT"

Each font consists of one set of character outline data for each character contained in the font. Up to 256 characters may be contained in the font, provided that the total contained in one font is less than 15,328 bytes by twice the total number of outlines in the font. The end font code is a terminating code, and no data relating to the font can be accepted after this code.

Each character's outline data is:

(CHAR OUTLINE DATA)=(CHAR)(#OUTLINES)[(OUTLINE)], where the outline non-terminal is used once for each outline defined by the #OUTLINES terminal.

The character number is identical to the CHAR terminal described in section above and is a number between 0 and 255 inclusive. The number of outlines per character is limited to 255.

Each outline consists of start coordinates, vectors and controls as required to describe one edge of the character:

(OUTLINE)=(YN)(XN)[(VECTORS)/(CONTROLS)], where the permissible controls are:

(CONTROLS)=(END OUTLINE)/(CHANGE DIRECTION)(NO VECTORS)/(LONG VERTICAL)/(SHALLOW HORIZONTAL)

The foregoing describes in specific detail the outline data structure syntactically covered in the two statements above. Reference should be made to this section; it is this data that should be transferred exactly from the floppy disk storage medium to the Output Data Processing System by the Input System for these two statements.

Table 4 summarizes the syntax of the font data structure:

TABLE 4

| FONT DATA SYNTAX | | |
|---|---|---|
| (FONT) | = | [(CHAR OUTLINE DATA)] "END FONT" |
| (CHAR OUTLINE DATA) | = | (CHAR) (#OUTLINES) [(OUTLINE)] |
| (OUTLINE) | = | (YN) (XN) [(VECTORS)/(CONTROLS)] |
| (CONTROLS) | = | (END OUTLINE)/(CHANGE DIR/ (NO VECTORS)/(LONG VERTICAL)/ (SHALLOW HORIZONTAL) |

DATA RAM

General:

The data RAM serves as an output buffer for the DMS, and an input buffer for the OCS. As line segment data is input to the DMS, it is reformatted and stored into the data RAM. Two such data RAMs are used within the system, each one is 32K bytes long. Both data RAMs are accessible by the DMS and the OCS with the following limitations:

(1) A processor may select and operate on only one data RAM at a time.

(2) A processor may not select a data RAM which is selected by the alternate processor.

(3) Once a processor deselects a data RAM (or releases control of it), any data within that RAM is no longer valid to that processor.

Figure 11:
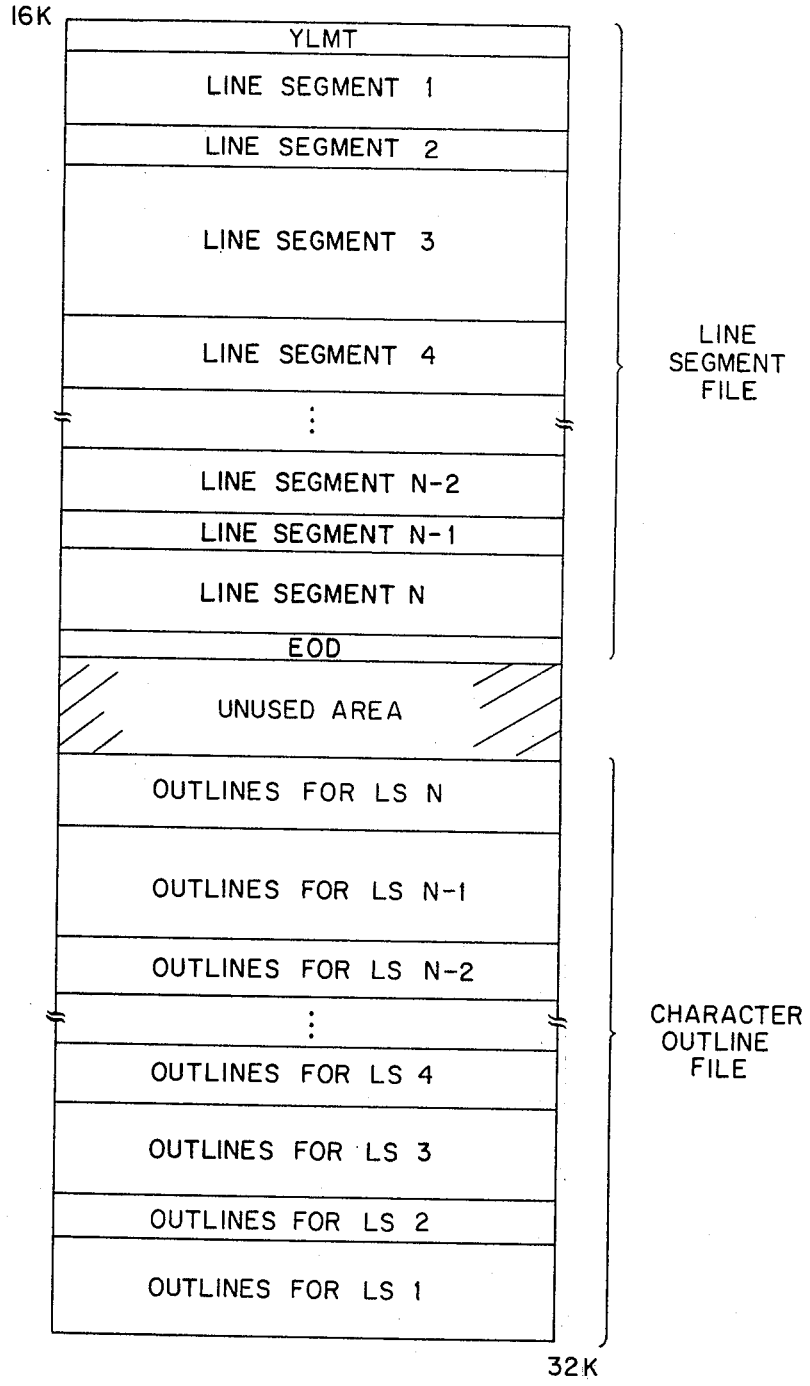
FIG. 11 is a diagram of the layout of data in the Data RAM.

Data RAM Building:

The data RAMs are developed by the DMS and passed onto the OCS for processing. Double buffering FIG. 11 is used in building up the data and therefore two such RAMS exist. This permits the DMS to develop the next buffer of data while the OCS is processing the other. In developing this data RAM, the DMS attempts to fill it with as much data as possible. By so doing, it should provide the OCS with enough data to work with to avoid the possibility of phototype setting unit (PTU) slow down.

The buffer space is optimized by sharing outline data that has been put into the buffer for other line segments. In order to achieve this, the DMS develops the RAM from two directions. Line segment data, as it is read in and reformatted, is put at the low end of memory, and related character outline data is put at the high end. When these two data sets interfere with each other, the data is backed up to the last complete line segment and the output limit is defined. The flow charts for smoothing the encoded character outlines are shown in FIGS. 15 through 18.

As shown in FIGS. 7 and 8, the character profile straight lines are arranged within the font RAM shown by the encoded X and Y start points and outline straight line vector profile addresses in the RAM.

This invention is described with reference to a one-dimensional scanner moving across the width of a page and through a series of characters intersecting that scan line, with the scanning beam forming successive raster lines in the direction down the page. The preferable manner of encoding the characters for this system is as shown in FIG. 5 with the X and Y start points for each outline straight line profile being at the top of the character and then proceeding generally in a downward direction.

Figure 9:
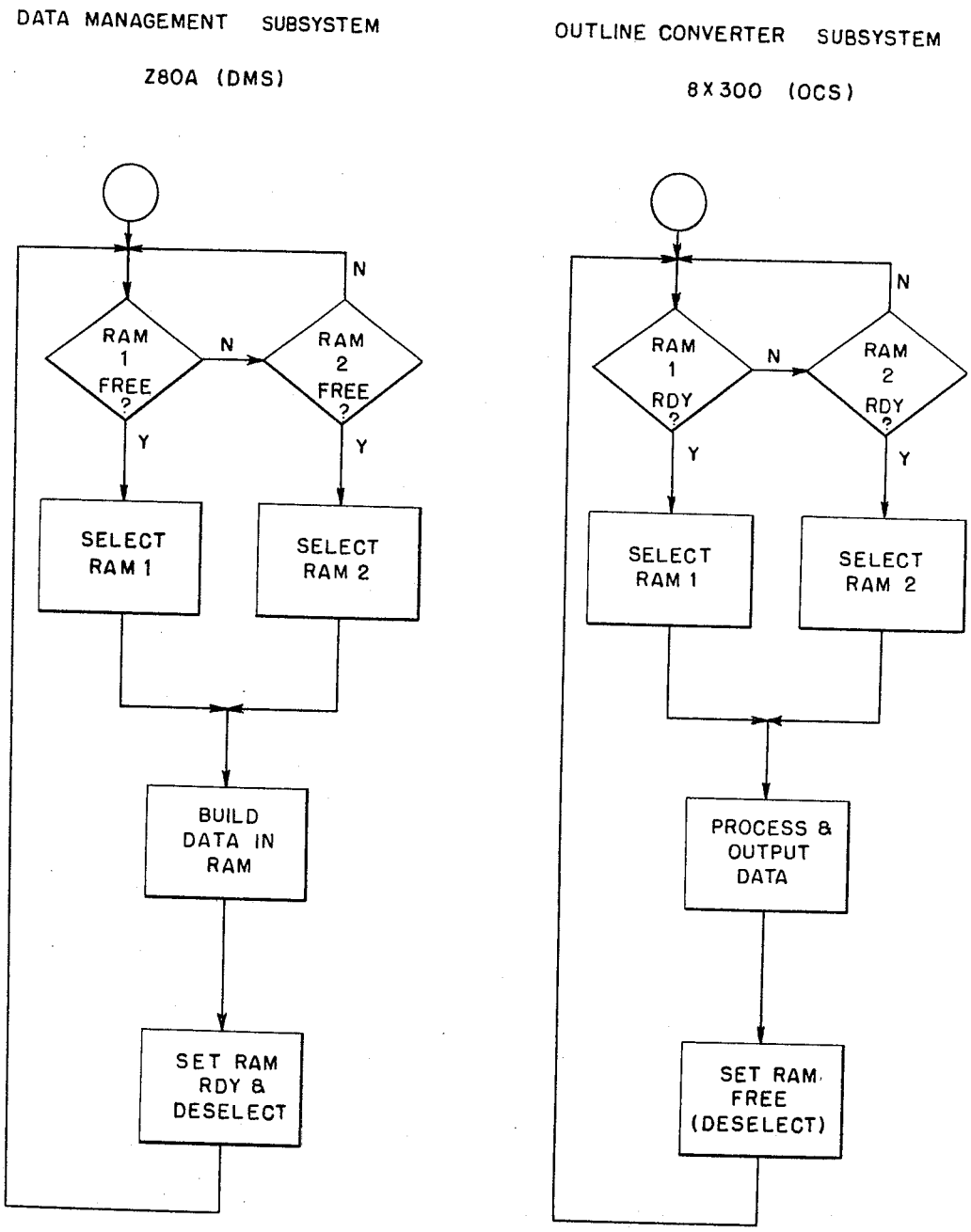
FIG. 9 contains flow diagrams showing the basic operation of the Data Management Subsystem and the Outline Converter Subsystem.
Figure 10:
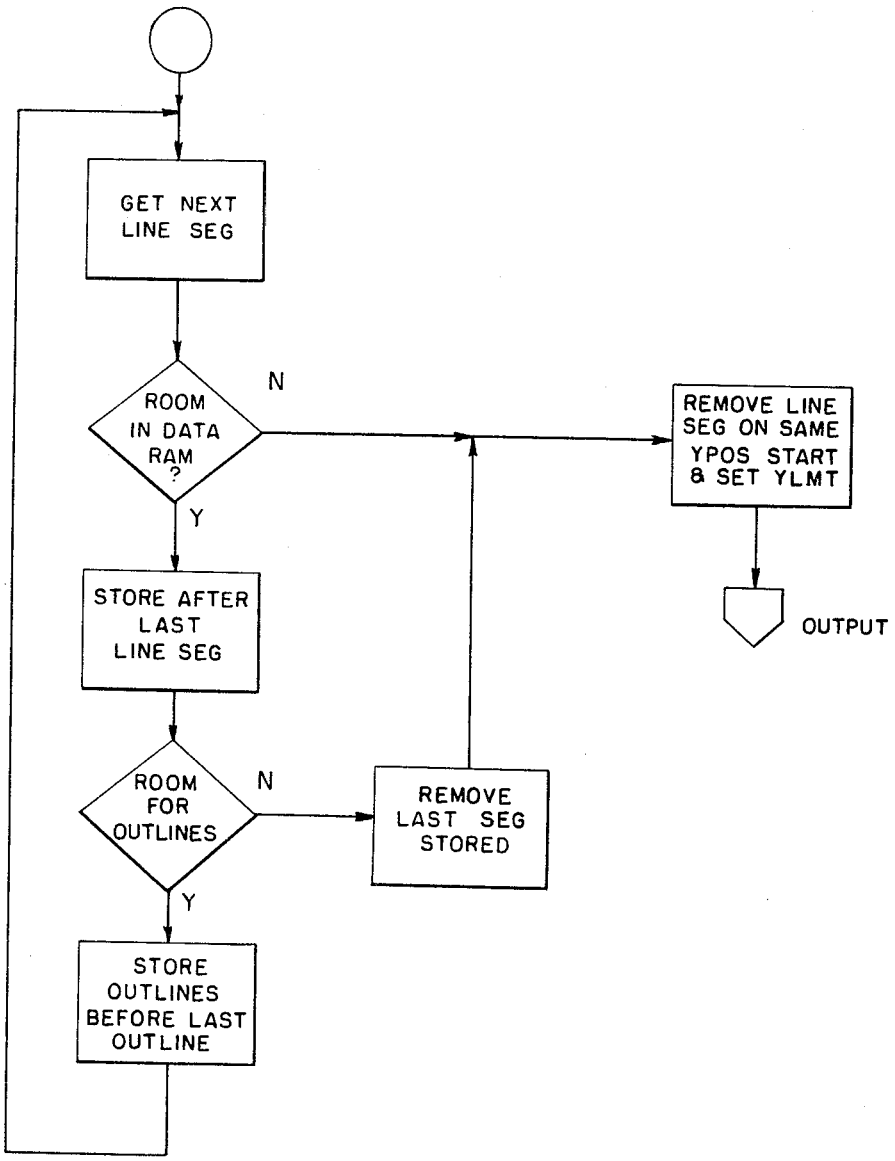
FIG. 10 is a flow diagram for the building of data in the Data RAM in the Data Management Subsystem.

FIGS. 9 and 10 show the manner of entering the font and line data into the Data Ram memory 84 and 86 (FIG. 2).

As stated, the outline contour is defined by straight lines. These straight lines may be encoded as vectors as shown or by other suitable encoding.

Figure 13:
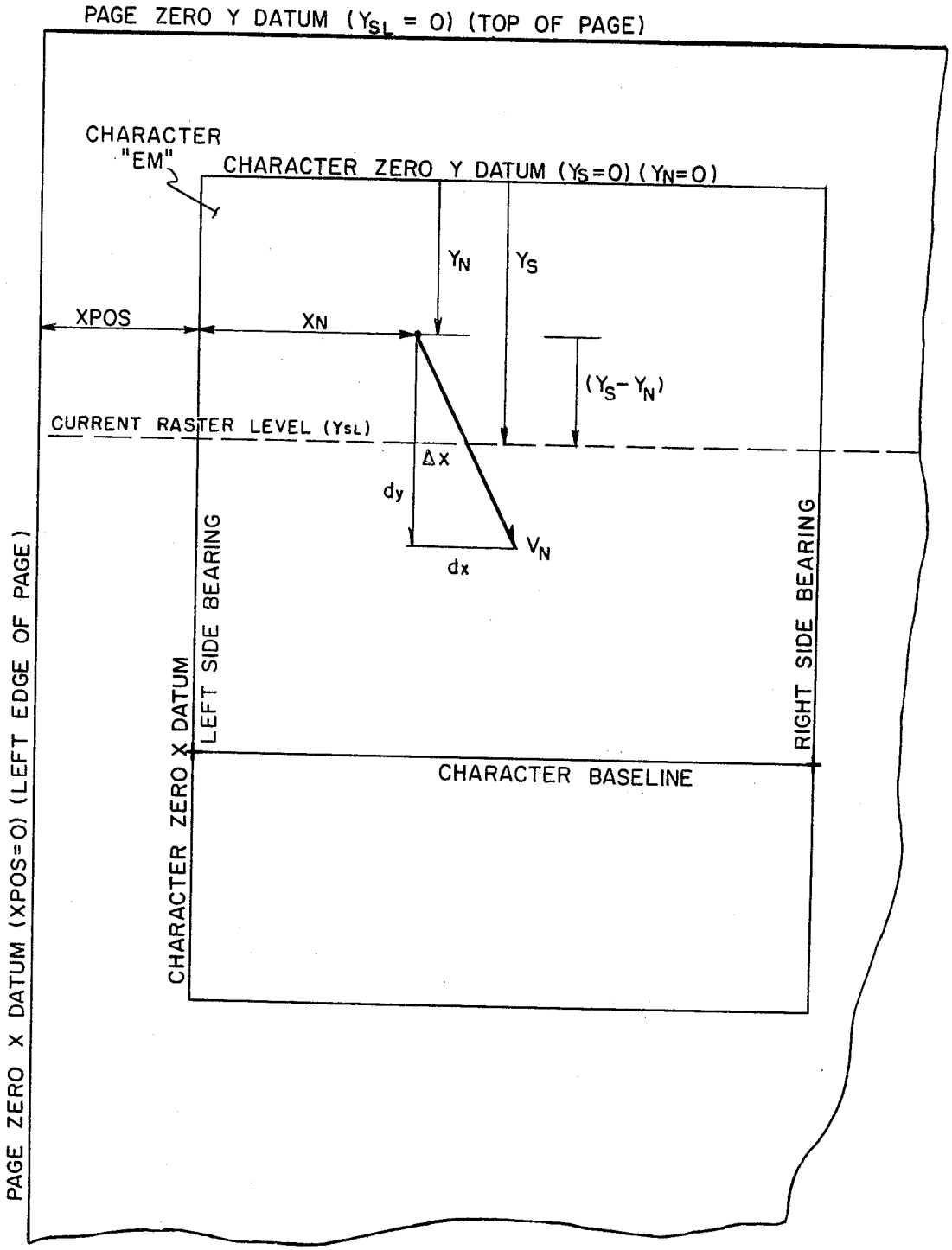
FIG. 13 shows the location of each raster line character outline intersection derived from the encoded data of FIG. 5.

The significance of the X and Y start points and the X and Y coordinate distances (dx, dy) of each vector in the vector profile is shown in FIGS. 5 and 13. The vector profile string FIG. 13 is shown starting at Xn, Yn with the first vector of the profile Vn comprising X and Y coordinate distances dx, dy.

The current raster level is shown as Ysl and the character intersection point is where vector Vn intersects raster level Ysl.

The output data system derives the proper vertical and horizontal scaling codes from the specified character size entered into the input system by the composer. It then uses the normalized encoded data and the scaling information to compute the aforesaid intersection points and causes the beam to be blanked and unblanked. This process does not form part of this invention and is described in greater detail in the related application Ser. No. 950,242.

However, in accordance with the principles of this invention, where the scaling will produce an expanded size character producing a discernible angled or irregular outline rather than a smooth outline, the method and apparatus of this invention then may be used to alter the encoded vector outline profile and replace selected straight lines of that profile with replacement outlines to produce a smoother outline at the selected size.

Figure 19:
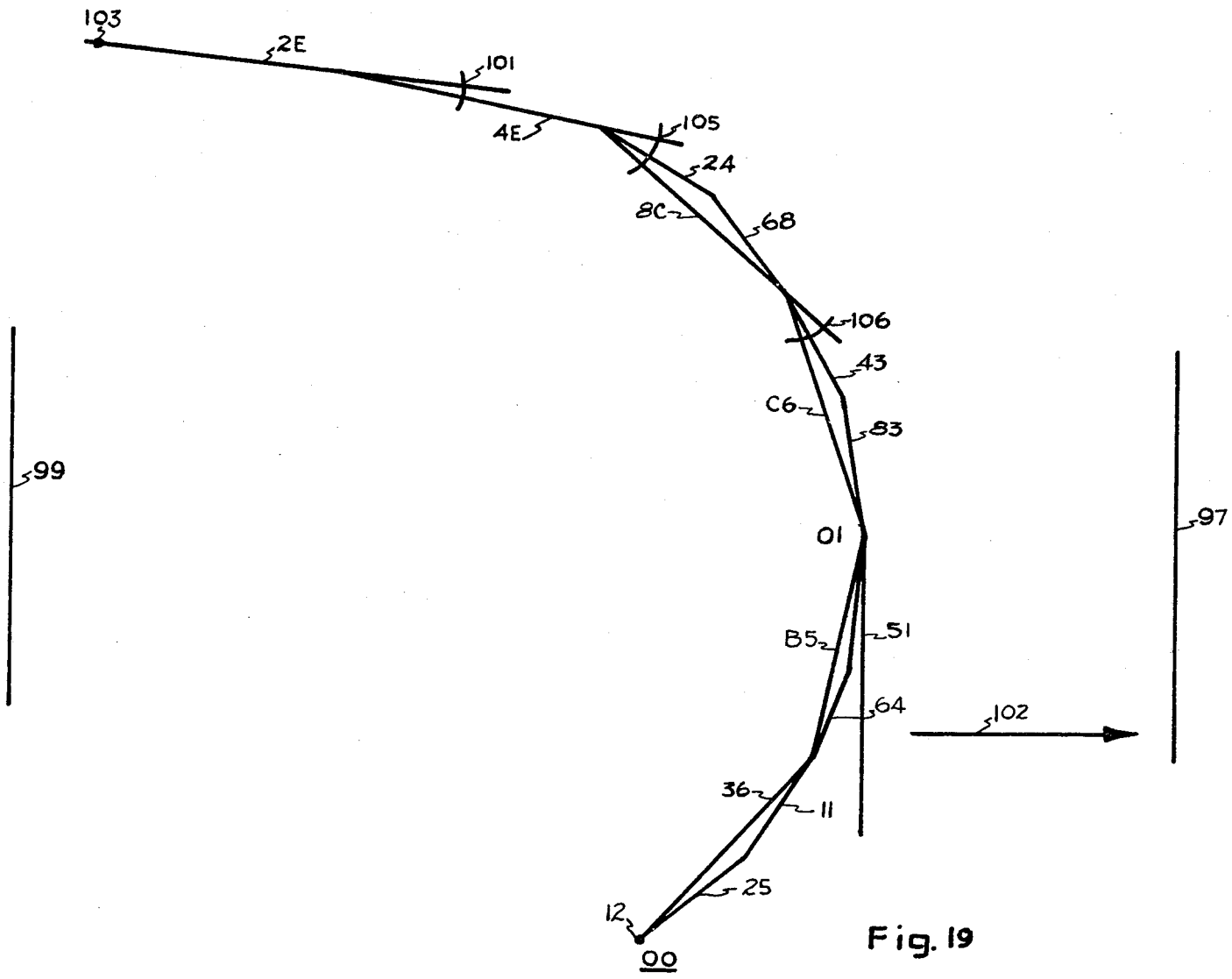
FIG. 19 shows an outline straight line profile smoothed by the Table Explosion process.

Examples of outlines producing discernible irregularies when expanded would be an outline profile as shown in FIG. 19.

The examples shown are for an encoding convention where outline straight line profiles start from the top most position of the character and proceed in the generally downward direction towards the end of the character. The outline vector profile shown will be generally transverse to the scanning beam direction.

The start points and the direction of the vector profile chosen may be altered to any orientation consistent with the principles of this invention and the method and apparatus shown here should not be limited to the character orientation relative to the general vector profile direction shown. For example, the start points may be chosen at the left most side of the character with the outline straight line profiles proceding generally laterally or horizontally, consistent with the generally accepted orientation of Latin characters. Outlines appear always in pairs, a pair of outline profiles defining a portion of the character between them. For the sake of explanation, only single outline profiles are shown. Each profile contains contiguous straight lines, defined by vector encoding, each vector having a start point and end point.

According to the principles of this invention, a character having substantial angularities between any contiguous straight lines in any outline profile may produce discernible and undesirable angularities in the outline of a character when that character is expanded to a desired size and image.

For example, an outline vector profile having successive vectors with an angularity difference (delta angularity) greater than 10° may produce an unsuitable outline when that character is imaged at a size in excess of 50 points.

Then according to the principles of the invention, a predetermined size or standard is chosen for altering the vector outline profile when it is to be imaged beyond that size standard as the encoded vectors defining the character outlines would produce excessive angularity in the outlines and unsuitable character images.

Successive vectors for characters beyond a predetermined size are compared for the delta angularity between those vectors. This delta angularity is then compared to a delta angularity standard to determine whether the profile should be altered to produce a smoother character outline at the enlarged size.

Figure 14:
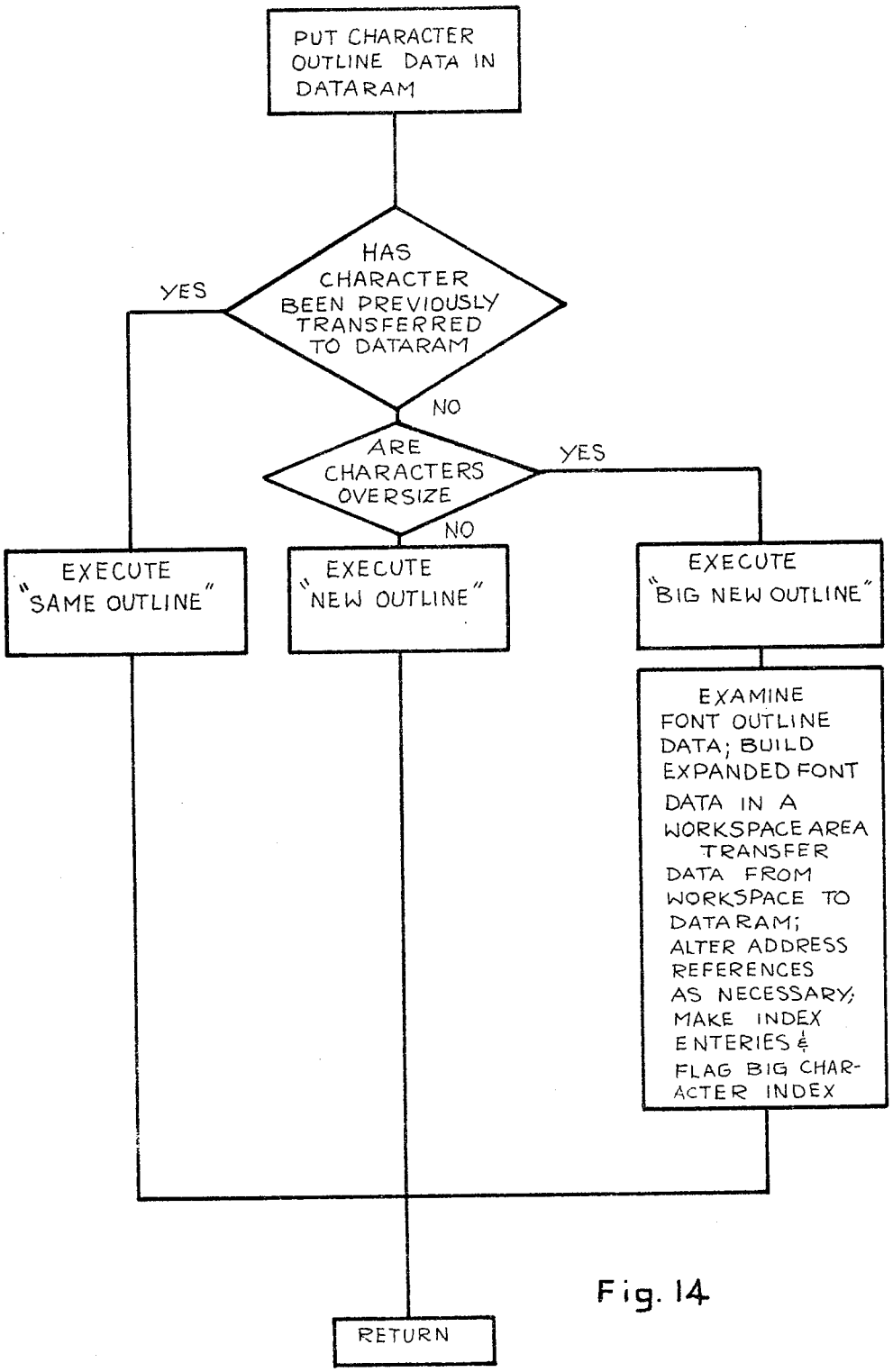
FIG. 14 is the overall flow chart showing routines for loading the character data into the Data Ram and the "Big New Outline" process for altering the encoded character data to create a smoother outline for a large character.

Following the flow chart of FIG. 14, the character data is transferred from the font ram 82 in FIG. 2 to the Data Ram memory 84, 86. If the character has been previously transferred to the Data Ram as shown on an In Ram index table then the Header data will be copied into the Data Ram at the profile location and the outline vector 3 profile data from the previous entries for that character will be utilized thereby saving Ram space.

If the character has not been previously transferred to the Data Ram, a decision is made whether the point size or the size of the character is beyond the predetermined standard size. This predetermined size may be an absolute point size or may be an overall dimension of the imaged character or may be a factor of the normalized encoded size, for example 10 times the normalized encoded point size, or any other suitable standard.

If the specified character size is less than the standard the data management system microprocessor 78 continues to add or transfer character data from the font ram 82 to the data rams 84, 86.

Where the specified size of the character exceeds the standard, then "Big New Outline" is utilized. The encoded outline profiles for the character are examined and new character vector outline profiles are built in a work space area. After expanding the character outlines the new encoded profiles are transferred from the work space to the Data Ram and the address references are entered in the In Ram table or the In Segment table.

The method for altering oversize characeters is shown in the FIGS. 15 to 18.

An apparatus which may be used to expand the font data is the microprocessor 78 shown as the Z80 which is also used in the data management subsystem to transfer the font data from the font ram 82 to the shared data rams 84 and 86.

According to the principles of this invention, the amount of space available in the Data Ram must be sufficient for at least an unexpanded font.

Where space is available, then houskeeping loop parameters are established such as the pointers, the character size count, the remaining space available in Ram, the flags for two smoothing passes and the Y count (the number of profile passes).

Some routines for expanding the vector profiles may require at least two passes to produce a sufficiently refined vector profile and character outline shape. The number of passes is a function of the degree of refinement desired in the curves of the imaged character outline.

Figure 15:
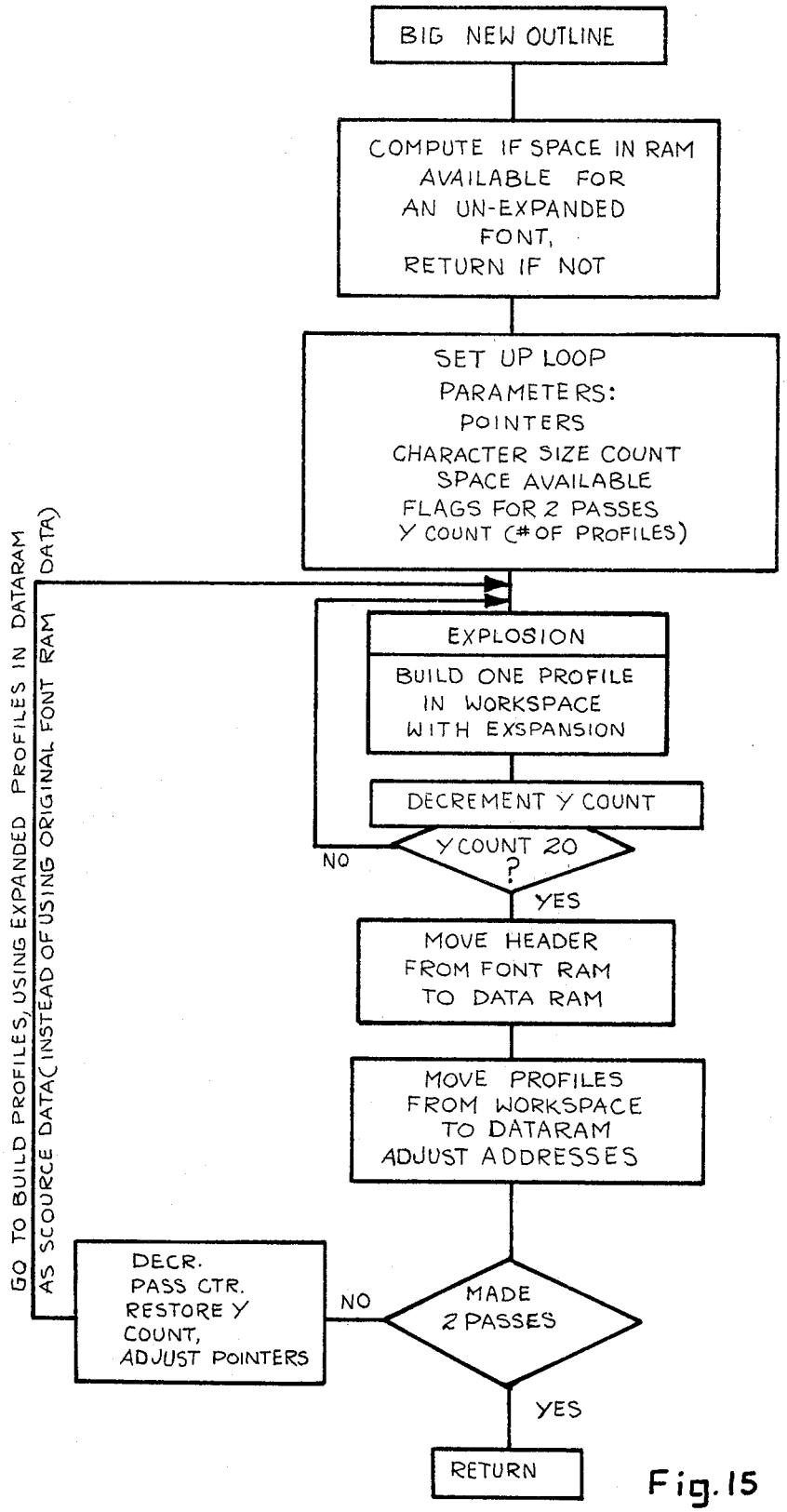
FIG. 15 shows an initial portion of the "Big New Outline" process leading to the subprocesses of FIGS. 16 to 18 and particularly the String Explosion process of FIGS. 16 and 17, and the Table Explosion process of FIGS. 16 and 18.
Figure 16:
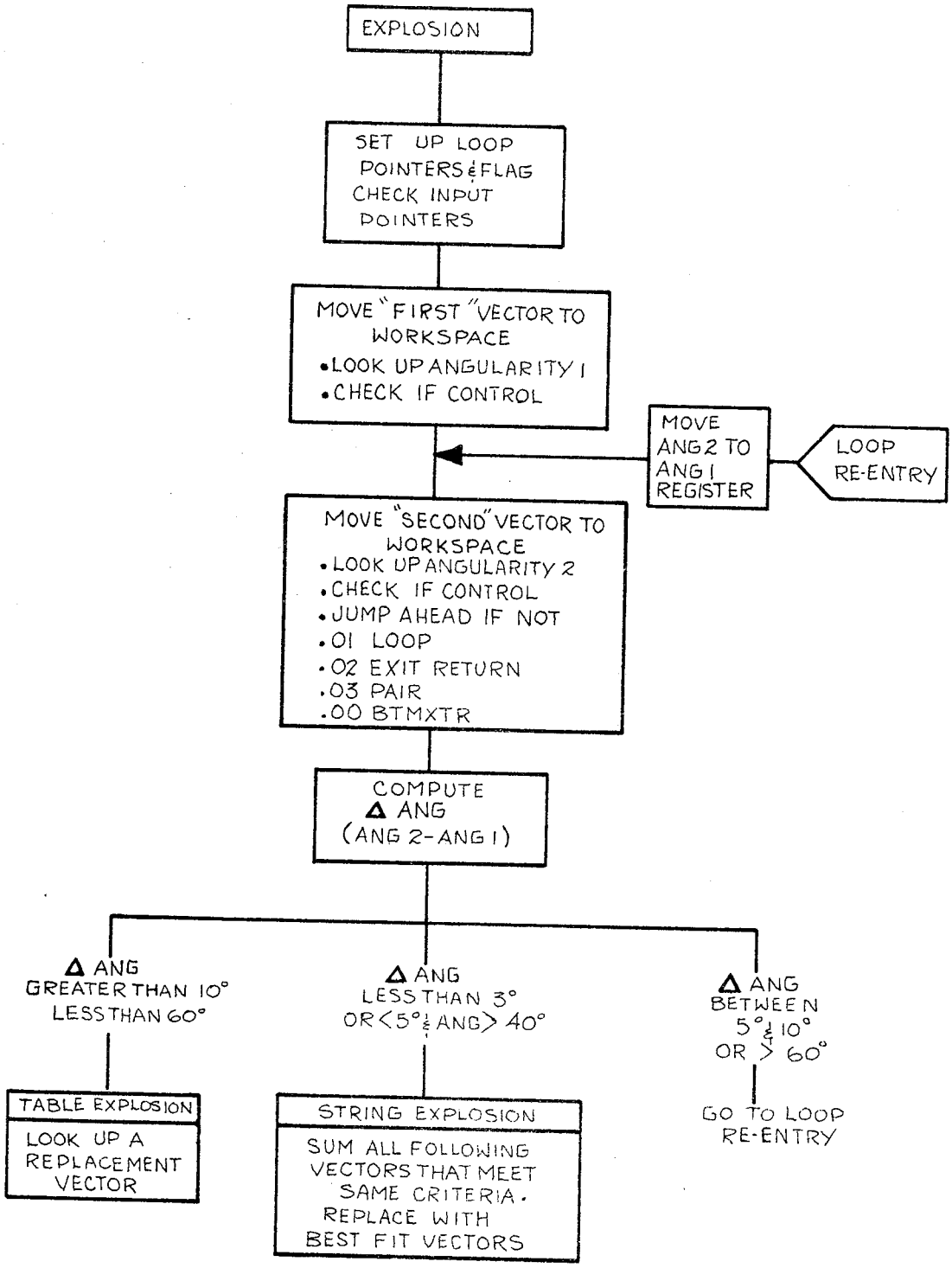
FIG. 16 shows in detail the process of FIG. 15, leading to the separate processes of FIGS. 17, 18.

The outline Explosion process shown in FIGS. 15 and 16 is then provided according to the principles of the invention to build the expanded outline profile in the work space and create a smoother outline.

As shown in FIG. 15, the Explosion routine is reiterated for each character outline or profile, and a register holding an outline pass count shown as Y count is decremented after each iteration until all profiles for a character are smoothed as directed by a Y=0 count.

Figure 12:
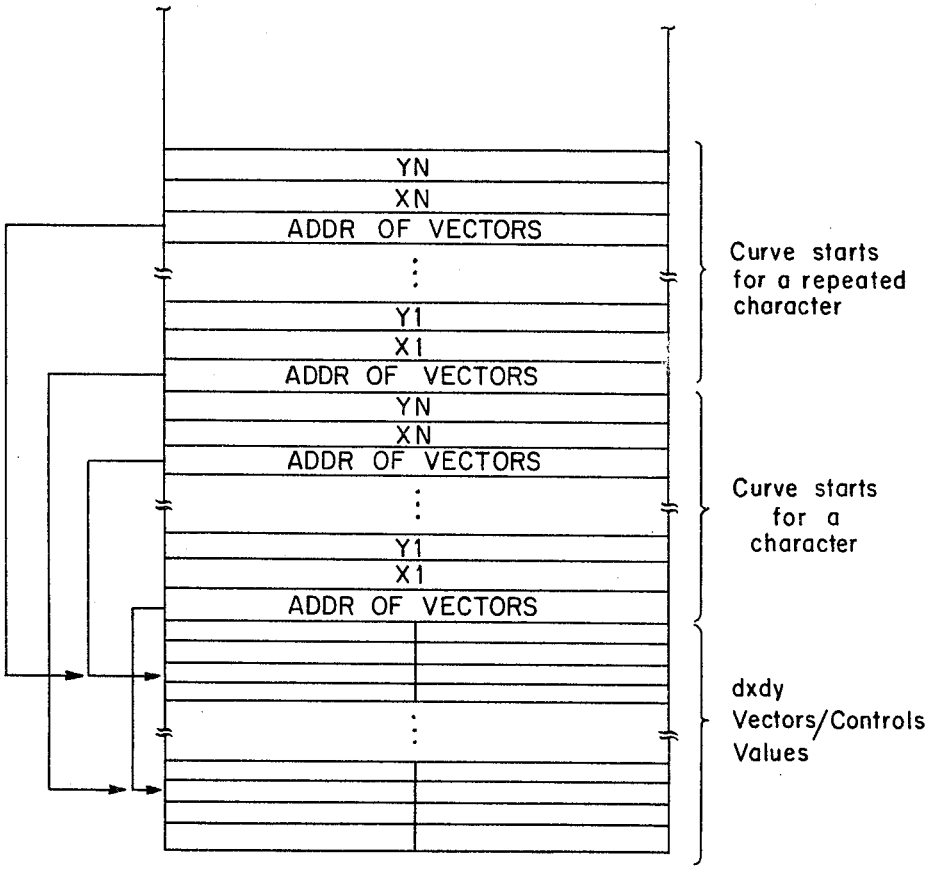
FIG. 12 is a diagram showing the structure of the outline data in the Data RAM.

Upon completion of the smoothing process, the Header data for the smoothed character is moved from the font ram to the Data Ram and the new outline profiles are moved from the work space to the Data Ram. The addresses in the In Ram and In Segment table are adjusted to reflect the proper address for the outline vector profiles as shown in FIG. 12.

The smoothing process may be reiterrated in a plurality of passes using the previously smoothed profiles now in the Data Ram instead of the original font ram data.

A look-up table of 256 data locations may be used to provide the angularity of each vector relative to a reference angle and to the dx dy vector coordinates.

As shown in FIG. 5, the vectors are encoded by start points (for example x1y1, x2y2) and vector profiles (dy, dx11), (dy, dx12), and so on. The look-up table relates 256 combinations of dy and dx coordinate distances to a specific angle angle relative to a reference angle. A look up table may be chosen as one alternative in determining the delta angularity.

As stated before, the outline data words (FIG. 6) may be vector coordinate distances (dx, dy, values) or control words, as control words may be encoded within the outline vector profile sequence.

The control coding may be a short hand for encoding certain vectors as shown in pages 20–21 and below:

Controls

00—end of outline
01—change direction, relative to an established reference
02—end point and start point (a point) replaced with IF
03—dx=0 dy=value of next byte, re FF
04—dx=1 dy=30
05—dx=1 dy=60
06—dx=1 dy=120
07—null code
08-OC—not used
OD—dy=1 dx=next byte, ie FF
OE—dy=1 dx=250 plus next byte
OF—dy=1 dx=next byte greater than 15 data resolution units.

Assuming that the first word in an outline profile is a vector, (See FIG. 16) then that first identified vector of the outline profile is moved to the work space 80 and its angularity registered. The next or second identified vector of that profile proceeding in a direction from the profile start point is moved to the workspace and its angularity registered.

The angular difference or delta angularity between the first vector and the second vector is then obtained and compared to a standard.

Depending upon the delta difference, the identified vectors in the profile string may be replaced with Replacement Vectors or additional vectors in the outline profile further from the profile start point may be examined and tested against the standard and then retained or replaced as necessary to maintain a smooth character outline.

Figure 17:
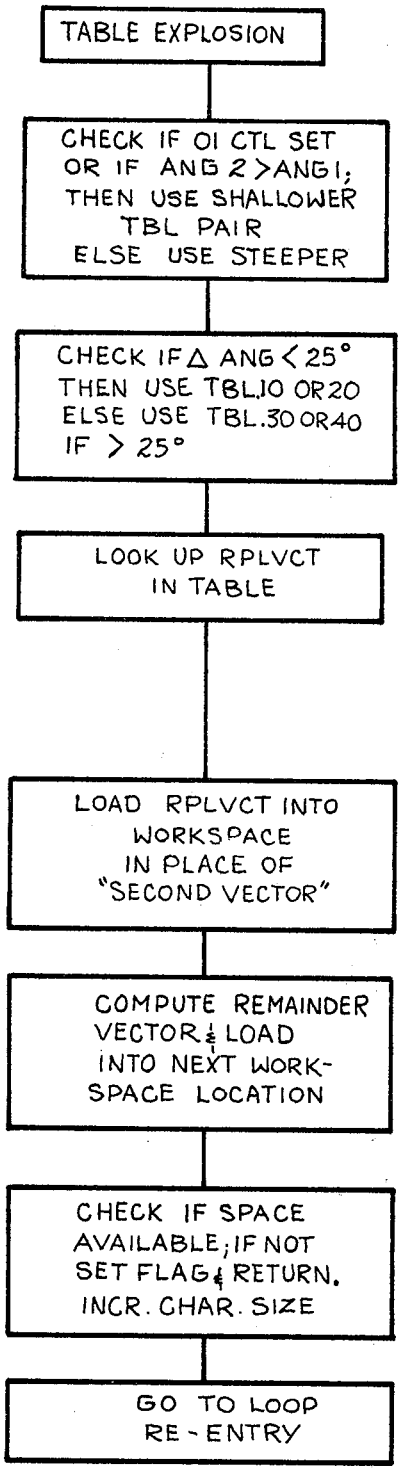
FIG. 17 shows the flow chart for the Table Explosion process.

For example, according to the principles of this invention, where the delta angularity is greater than 10° and less than 60°, the profile vector, furthest from the start point of the two compared vectors, is replaced with at least two other Replacement Vectors by the Table Explosion process, FIG. 17.

As shown in the straight line profile of FIG. 19, and as stated above, the delta angularity (angle 101) formed by identified profile vectors are compared to each other and with a standard or reference angle. The second vector of each compared pair, that begins from the start point 103 may be replaced. The Replacement Vectors and vectors chosen for replacement will depend upon the relationship of the second vector in the string to the first vector and to the reference angle.

However in the preferred embodiment the second vector, from the profile start point 103 is replaced, by a replacement vector selected from a series of four tables. However, it should be recognized that according to the principle of this invention, the number of tables of Replacement Vectors and the criteria for selecting these tables may change depending upon the angularity of the encoded vectors, the shape of the character outline desired, and the conventions chosen.

In the preferred embodiment, four tables are provided for Replacement Vectors as follows for the Table Explosion FIG. 17. The Table selection criteria is described in tabular form in the following description.

Table 10 provides replacement vectors where the delta angularity is less than 25° and the second vector angularity is closer than the first vector angularity to a reference angle. (Second vector shallower than first vector).

Table 20 is provided for replacement vectors where the delta angularity is less than 25° and the angularity of the second vector is further than the angularity of the first vector from the reference angle. (Second vector steeper than first vector).

Table 30 is provided where the delta angularity is greater than 25° and the second vector angularity is closer to than the first vector to the reference angle (Second vector shallower than the first vector).

Table 40 is provided where the delta angularity is greater than 25° and the second vector angularity is further than the first vector from the reference angle. (Second vector steeper than the first vector).

The encoding for the identified second vector from the vector profile start point 103 then is replaced with the replacement vector encoding.

However, according to the principles of the invention, the first vector adjacent to the start point may be replaced by the replacement vector encoding, depending upon the convention chosen to select and replace vectors.

The microprocessor 78 then removes the encoded data for the second vector in the string from the start point and replaces with an appropriate vector set from tables 10, 20, 30, 40.

The replacement vector data is inserted immediately following the encoded data for the first of the two identified vectors and consists of a replacement vector and remainder vector.

The method for determining the remainder vector is shown in FIG. 19. As shown in FIG. 19, the Replacement Vector is subtracted from the replaced vector coordinate distances to obtain the new remainder vector. For example, vector 8C is replaced with replacement vector 24 leaving a remainder 68 between the end of the replacement vector and the end point of the identified replaced vector.

As shown in FIG. 19, the Remainder vector can be calculated from the coordinates of the replacement vector 24 and the coordinates of the identified replaced vector 8C.

A second expansion process may be used where the delta angularity is less than 3° or where the delta angularity is less than 5° and greater than 3° and the angularity of one of the vectors of the two identified vectors is greater than 40°. This case most likely appears in an outline profile string and particularly in a long straight line such as one leg of the letter W. When the angularity of the first two vectors of a string exceeds the standard, then additional vectors in the outline vector profile string (i.e. vectors 3, 4, and on) are compared to the first vector loaded into the work space and the delta angularity is compared to a standard angularity.

According to the process, where the delta angularity is as stated above, the string explosion process is used and the angularity of each additional vector of the string is compared to the first vector. The cumulative X and Y coordinate distances $\Sigma X$, $\Sigma Y$ are used in computing the replacement vector. Each additional vector in the profile string is compared with the first vector of the string for delta angularity and delta angularity is compared to the standard. Where the delta angularity between the first identified vector and each additional vector is within the standard as it was between the first and second vector, no Replacement Vectors are inserted.

However, where the delta angularity between any one additional vectors and the first vector is in excess or outside the standard, then a replacement vector is indicated. In this case, the slope of the cumulative X and Y coordinate distances $\Sigma x$, $\Sigma y$ is computed and the replacement vector is selected having the same slope $\Sigma x/\Sigma y$ from a table.

However, where the Replacement Vector length is less than the total vector string length as may be represented by the summation of the X and Y coordinate distances, $\Sigma x$, $\Sigma y$ then the identified outlines may be retained without any outlines replaced.

The reason is a string may be so small that its effect on the imaged character may be negligible and replacement may be unnecessary. Where the string length is greater than a predetermined size, then the vector string may be replaced.

The details of the method and the apparatus according to the principles of the invention are now described with particular reference to encoded straight line data defining a portion of an outline with a character.

As described with reference to FIG. 11, the line segments are loaded into one of the shared Data Ram memories, 84, 86 by the microprocessor 78.

In the course of loading the data ram, the microprocessor 78 scans each line segment for a font call. If the font has not previously been loaded into the font ram, then the microprocessor appropriately loads the required font into the font ram for transfer to the data ram.

At this point, the microprocessor may identify the size of the character required for display and, responsive to a selected size standard for example a size in excess of 50 point, initiate the procedure for smoothing the outline profiles by altering the normalized encoded data base. The normalized encoded character data base comprises a plurality of encoded straight lines extending successively along the character outline. The straight lines may be encoded as vectors or be encoded by any other suitable technique. The method disclosed may be used with any straight line encoded outline.

The method includes the steps of selecting a character and character size for display, identifying at least two encoded outline straight lines in the profile, comparing the angle between the straight lines to a standard, and replacing the code for at least one of said identified straight lines with the code for at least two replacement straight lines in response to said comparison, with one of said replacement straight lines being continuous with the non-replaced identified encoded outline straight line. The result is the non-replaced and the replacement straight lines define a smoother outline profile.

Particularly disclosed is at least one of the replacement straight lines is encoded in the outline data to be continuous with the non-replaced outline straight lines and to define an angle with the non-replaced straight lines less than the angle between the original two encoded outline straight lines.

The method smooths the outline profiles and is generally referred to in the following as an Explosion of the outline profiles although it should be understood this refers to the method and an Explosion of the data does not necessarily take place for all outlines under all circumstances.

As stated previously, one character size may be selected and may serve as a threshold size or standard, defining larger size characters above the standard which m may be exploded and those outlines below the threshold which need not be exploded. Where the character size is in excess of the standard, size and the character has not been previously loaded into Data Ram, then the method shown as Big New Outline in FIG. 14 is followed. If the character is less than the threshold size, then the New Outline or same Outline Process is followed and the character data is loaded from the font ram into the data ram.

FIG. 14 is a flow chart generally describing the above process. That routine is called "Put Character Data Outline in Data Ram" and starts with the decision whether the character has been previously transferred to the Data Ram. Where the character has been previously transferred, then the Header Data is copied into the Data Ram and the data ram index is altered consistently.

Where the character has not been previously transferred to the data ram, and the point size of the character is less than the above-mentioned size standard or threshhold point size, then the font data from the font ram is transferred to the data ram and the Data Ram address references are altered as necessary.

However, where the point size is in excess of the size standard then the method according to the principles of the invention is implemented, referred to in FIG. 15 as "Big New Outline" comprising the examination of the font outline data, the building of an expanded font data in the work space area 80, the transferring data from the work space 80 to the Data Ram 84, 86 and the alteration of address references and the preparation of new index entries and flags as appropriate for the data.

As shown in FIG. 15, where the point size is above the size standard or threshold initiating the Big New Outline shown in FIG. 15, the microprocessor 78 must first determine if sufficient memory space exists in either one of the shared Data memory Rams 84 and 86.

If sufficient space is not available as explained in the foregoing, then the line segment and the font outline data must be transferred to the other shared Data memory Ram.

As described in the foregoing, each character outline contains at least two profiles. Prior to the initiation of the Explosion routine for smoothing the outline profiles, housekeeping parameters must be established such as pointer values, a Y count register to indicate the number of outline profiles processed, the flags for at least two passes, an indication of the space available in the work space, and the character size count.

Smoothing of the outline profiles takes place by building the smoothed profiles in the work space.

At the conclusion of the smoothing of the outlines according to the explosion method, the Header Data is moved from the front ram to the Data Ram and the new encoded profiles are moved from the work space to the Data Ram with addresses adjusted appropriately for the character data entries, as shown in FIG. 12.

Consistent with the principles of this invention, the outline smoothing method may be reiterrated using the initial data moved from the work space to the Data Ram and the profiles are again made more smooth using the expanded smoothed profiles in the Data Ram, to insure that the smoothing of the outline profiles has produced the smoothest outline consistent with processing time and memory space.

According to the principles of this invention, it is invisioned that at least two passes will be made, a first pass using the original encoded character data and the second pass using the new encoded character data produced by the first smoothing process.

As previously shown, in FIG. 6, the character data includes a Y data word and an X data word comprising the Header data and as shown in FIG. 8 and an address corresponding to the encoded straight line profile strings defined in terms of dx and dy coordinates.

The profiles may also contain control data indispersed with the dx and dy vector coordinate data as shown in FIG. 6.

The control data is indicated by the zero value for the dy portion of the vector/control data byte corresponding to the four most significant pits.

For example, code 00 indicates the ends of a profile. A vector change direction, is indicated by the control code 01 to indicate that the vector while proceeding in the generally downward direction with respect to a vertical 95 parallel to a side bearing 99 of FIG. 19 has now changed direction, and crossed over the vertical 95 and is proceeding towards the other side of the em square, see FIG. 5. The change of direction is shown with regard to FIG. 19 wherein the vectors proceed in a downward direction and towards the right side bearing 97 of the em until the end of vector C6. The profile then crosses over the vertical reference 95 parallel to the left and right side bearings 99, 97 and the profile direction continues downward and towards the left side bearing 99.

Code 02 indicates a point on the outline and may be replaced by a vector such as dx=1, dy=15.

Code 03 indicates a substantially vertical line with dx equal to zero and the value of the dy coordinate equal to the value of the next byte (i.e. FF equal to 255 units).

As can be seen above, the control codes may be vector directions expressed as instructions or may be strictly interpreted as controls as shown by the foregoing Table 5.

A look up table is used to relate a specific number of combinations of dx and dy coordinates to specific angles. The specific angles are also related to a reference angle. The reference angle may be a horizontal parallel to the character base line and with the table relating the dx and dy coordinate values of each vector to a specific angular value referred to angularity.

As shown above, the method is implemented under control of a microprocessor shown as 78.

According to FIG. 14, where a character above a threshold size is identified, then the profile data comprising the vector profile defining the outline is loaded into the work space.

Particularly, encoded data of the first vector of the profile is loaded into the work space which may be for example a register. The outline profile may comprise vectors as shown in FIG. 19 where the profile comprises vectors 2E, 4E, 8C, C6, 01, B5, 36, and 00, indicating the profile end.

The vector profile data shown in FIG. 19 contains the control code 01 to indicate a change of direction with respect to the vertical 95 and indicating a change in the way the successive identified vectors angularities are compared. The string then continues with vectors B5, 36 and 00.

In this regard, it should be noted that vector 2E (hexadecimal) for example may mean the X coordinate distances is 14 units and the Y coordinate distance is 2 units.

Referring to FIG. 16, the first identified vector in the outline vector profile is moved to the work space which as stated above could be a register.

The angularity of the first vector is then obtained from the angularity Look Up Table as described.

The first vector is examined to determine if it is control code as shown in Table 5. If it is not a control code, the four most significant bits are not zero then the method of smoothing is continued.

If a control code is indicated, then depending upon what the value of the four least significant bits are, the process will be modified as explained in the following.

Assuming that the first vector is not a control code but a vector direction having a dx and a dy coordinate distance value, then a second identified vector angularity, following the first vector for example is moved to the work space which may be for example a second register.

At this point, using the example of FIG. 19 the first vector would be 2E and a second vector would be 4E. The first register would be loaded with the angularity of 2E and the second register would be loaded with the angularity of 4E.

Each of the registers would have the value of the angularity of vector 2E (E8) and of vector 4E (D2) derived from the Look Up Table.

The angularity of each of the vectors are then compared to determine the occurrence of either:

Case 1: (String Explosion) The delta angularity is less than 5° and greater than 3° and where one of the identified vectors has an angularity in excess of 40°.

Case 2. (Table Explosion) The delta angularity is greater than 10° and less than 60°.

Case 3. The delta angularity is between 5° and 10° (no explosion), or greater than 60°.

The angularities of two identified outlines are compared to determine the delta angularity. This comparison will indicate either the occurrence of case 1, case 2 or case 3. Where case 1 or 2 is indicated, then the String or Table Explosion process follows accordingly. Once a table or string explosion is indicated, then the successive outlines in the profile are tested for delta angularity and may be compared to the same standard of either case 1 or 2 initiating the respective explosion process.

Where the delta angularity is between 5° and 10° or greater than 60°, no explosion is indicated and the angularity value of the second vector 4E is moved to the first register and the angularity of the next successive vector, the third vector shown as 8C, is moved to the second register and the process of computing the delta angularity between identified vectors is repeated.

In this regard, the first register is referred to as the "first" because it holds the angularity of the vector closest to the vector profile start point while the second vector register is referred to as second because it holds the angularity of the vector furthest from the profile start point, of the two identified vectors.

The method of smoothing is implemented in Cases 1 and 2 above, although the angularity standards may be changed without deviating from the principles of the invention.

To further aid in explanation, the method according to the invention of smoothing with regard to case 2 is referred to as a Table Explosion while the method of smoothing with regard to case 1 above is referred to as a String explosion.

The Table Explosion is explained using the profile outline string of FIG. 19 and table 4 below.

As explained previously, although not necessary to the implementation of the invention, the method may use two passes, the first pass using the data of the outline profile in the font ram and the second pass using the new vector profiles derived from the original profiles and the replacement profile data defining a smoother curve.

The first vector is defined as the vector closest to the vector profile start point, 103 FIG. 19. The angularity E8 of the first vector 2E, is loaded into the first register. The angularity value D2 of the second vector, 4E is then loaded into the second register.

The identified and replacement vector encoding, angularity, and delta angularity is shown in Table 5 and expressed hexadecimal notation.

TABLE 5

| Vector String | Angularity | Angularity | Replacement Vector |
|---|---|---|---|
| 2E | E8 | 16 | |
| 4E | D2 | | |
| | | 32 | |
| 8C | A0 | | 24 |
| | | | 68 |
| | 97 | | |
| | | 4C | |
| C6 | 4B | | 43 |

TABLE 5-continued

| Vector String | Angularity | Angularity | Replacement Vector |
|---|---|---|---|
| 01 | 32 | | 83 |
| | | 97 | 01 |
| B5 | 45 | | 51 |
| | | | 64 |
| | 5F | | |
| | | 75 | |
| B6 | B4 | | 11 |
| | | | 25 |
| | | | 1F |
| 00 | | | 00 |

As shown, the angular difference 101 between the profile's first vector 2E and second vector 4E is a delta angularity of 16, less than or within the standard for Case 1 and Case 2 and within Case 3.

The method according to the Explosion routine of FIG. 16 then moves the angularity value of the second vector 4E to the first vector register and the angularity value A0 of the third vector 8C to the second vector register.

The delta angularity 105 between the identified two vectors are then compared. As shown in the table, the angularity difference or the delta angularity 105 between vectors 4E and 8C, the second and the third of the vectors in the profile is shown as 32.

As vectors 4E and 8C define a delta angularity falling into Case 2, the Table Explosion of FIG. 17 is implemented, as shown in FIG. 16.

In particular as stated before, and as shown for the preferred embodiment, four tables are used, for the replacement vector codes, each replacement vector is represented by encoded dx and dy values. These replacement vector codes may be substituted for any one of the identified vectors in the vector profiles.

In the case of the Table Explosion, there will be code for at least two replacement vectors, inserted for the code of one of the profile identified vectors. The code chosen will depend upon whether the delta angularity is greater or less than 25° and whether the one of the identified vectors of the profile and defining the delta angularity with another identified vector is steeper or shallower than the other vector. This may also be expressed as the relative angularity between identified vectors. In the case of the preferred embodiment, steeper or shallower means further from or closer to a reference angle than the other identified compared vector, although any suitable convention may be chosen.

In the case of vectors 8C and 4E, assuming the delta angularity is less than 25° and where vector 8C would be steeper than 4E, compared to a horizontal vector 102 of zero degrees, then the replacement vector from look up table 20 would be chosen, responsive to the delta angularity 32 and the relative angularity.

A suitable set of look up tables for delta angularity and relative angularity are shown for the preferred embodiment, but should not be thought of as limiting of the invention. These are:

| Table No. | Delta Angularity | Relative Angularity of vector B to Vector A |
|---|---|---|
| 10 | <25° | shallower |
| 20 | <25° | steeper |
| 30 | >25° | shallower |
| 40 | >25° | steeper |

Any suitable convention may be chosen for establishing replacement vector look up tables consistent with the final shape of the displayed character desired.

For example, a single look up table may be used or a plurality of look up tables constrained only by delta angularity or by relative angularity.

Referring to Table 5 and FIG. 19, the replacement vector pair 24–68 is used to replace vector 8C, the "second vector" compared with the "first vector" 4E, and having a delta angularity falling within Case 2.

The replacement vector pair code 24, 68 is derived from one of the Tables 10, 20, 30 or 40, encoded and is placed in data immediately following vector code 4E so that in continues the outline vector profile from the end point of vector 4E, through vector 24, and vector 68 to the end point of replacement vector 8C.

In the preferred implementation of the method, only the replacement vector 24 is stored. While the table may also store a vector replacement pair 24, 68, to save storage space the first replacement vector 24 may be stored in the table and loaded into the work space in place of the second vector 8C.

The remainder dx and dy coordinate distances between the vector coordinate distances of vector 8C and replacement vector 24 then may be obtained to derive a remainder vector 68 which would then be loaded into the next work space location following the encoded vector 24. With the encoding for vector 24 and 68 replacing the encoding of vector 8C, the profile string would continue from vector 4E, to vector 24, to vector 68, to the beginning of vector C6.

The next vector to be identified and compared is profile vector C6 which is one of the original vectors in the outline profile string. However, the vector now corresponding to the "first" vector would be vector 68. The angularity of vector 68 would then be loaded into the "first" vector register and with the angularity of vector C6 loaded into the "second" register. The angularity is then compared and replacement vectors chosen as before.

In this case, as the identified profile vector 8C has been replaced with replacement vectors 24 and 68, the angularity 4B of vector C6 is compared with the angularity 97 of vector 68 (the remainder vector) producing a delta angularity 106 of 4C falling into the standard for Case 2.

The replacement vectors shown for C6 would be 43 and 83 with the vector 43 being chosen from one of the look-up tables 10–40 and the vector 83 being computed from the remainder between the angularity of vector C6 and vector 43. The remainder vector in this case would be vector 83 having an angularity of 32.

As shown, the outline vector profile then passes through the vertical, 95 and proceeds from a direction generally downward and to the right direction to a generally downward and to the left direction.

This is denoted in the outline encoded profile by a control 01 following C6 and preceding B5.

Where a control code is identified the process loops back for a successive vector code and the code value is superceded by the angularity of the next identified vector.

As referred to in the foregoing table control code 01 indicates a direction change and a change in computation; angularity must be added instead of subtracted to determine the delta angularity. The use and placement of this code 01 will vary depending on the convention chosen for the encoding direction and for the derivation of the delta angularities.

As the original outline vector C6 has been replaced by vector replacement pair 43 and 83, the next identified vector B5 in the profile string supercedes the control code and B5 is loaded into the "second" vector register with the angularity value 32 of vector 83 being loaded into the first vector register. The delta angularity is now obtained by adding the two angularities 32 and 45 which sums to 97, falling into Case 2 and B5 is replaced by replacement vector 51 and the remainder vector 64 is similarly derived as shown.

Consistent with the process, the angularity of the next identified vector 36, loaded into the "second" register, and compared with the angularity of vector 64, in the first register to produce a delta angularity 75, indicating a corresponding replacement by vector 11 and remainder vector 25.

The next entry in the vector string is 00 indicating an end to the profile and directing that the profile string be terminated by a Bottom Extrapolation. (BTMXTR)

A Bottom Extrapolation is a separate routine which may be used to terminate all outline profiles.

Its purpose is to smooth the outline by rounding the bottom of each outline profile. It performs this function by extrapolating the angularity of the last vector in the profile.

Figure 22:
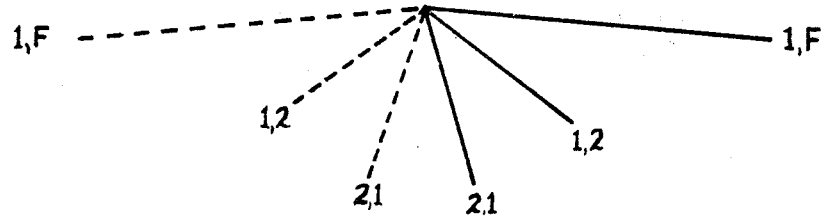
FIG. 22 shows the replacement straight line encoding following an end of profile condition.

In this case, the angularity of the last vector is 25. Depending upon the angularity of the last vector it will add one more vector to the profile which may be 1F, 10 or 12, shown in FIG. 22.

1F indicates a dy increment of 1 and the dx increment of 15.

11 indicates a dy increment of 1 and the dx increment of one.

12 indicates a dy increment of one and the dx increment of two.

The effect of the bottom extrapolation in the Table Explosion of FIG. 17 is shown by FIG. 19 in which encoding for vector 12 is added rounding the end of the profile.

Whereas the bottom extrapolation routine is shown with regard to the profile of FIG. 19 that should be understood that this bottom extrapolation routine initiated in response to a vector string code at 00 can be used with any outline vector string. To complete the encoding, code, 00 is added to the profile.

A second pass (not shown) may be initiated using the new vector profile string comprising vectors 2E, 4E, 24, 68, 43, 83, 01, 51, 64, 11, 25, 12 and 00. In this case, the first vectors compared would be vectors 2E and 4E, and then vectors 4E and 24 and so on.

Figure 20:
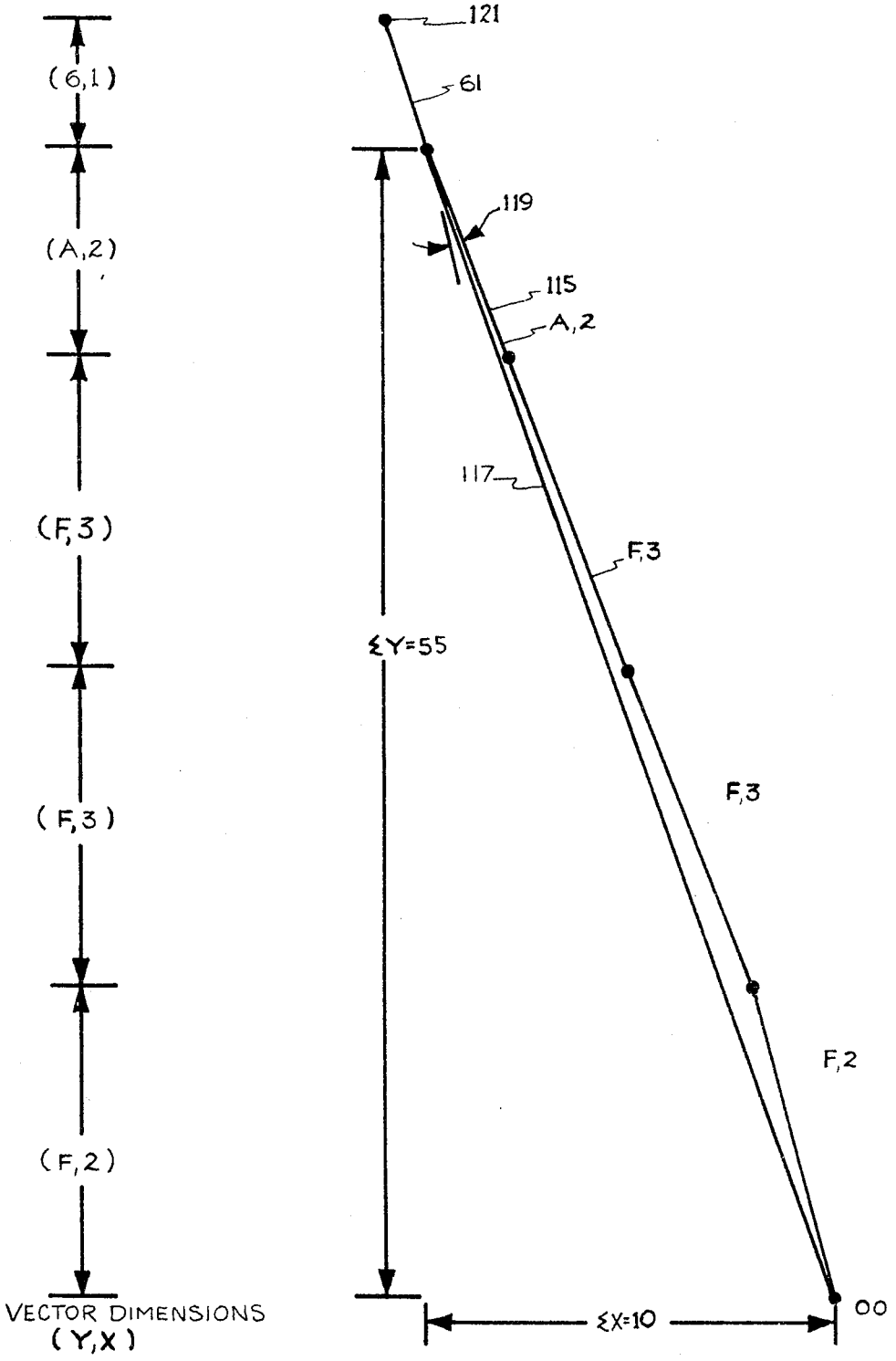
FIG. 20 shows an outline straight line profile smoothed by the String Explosion process.

Referring to FIG. 20, and Case 1, a method according to the String Explosion is shown for an outline that does not fit exactly into an encoded grid as shown in FIG. 20.

A letter outline such as the outline of a W when laid on an encoding grid may not fit exactly on the encoded grid points and the closest encoded grid points may be chosen to represent the vector outline.

The horizontal axis in FIG. 20 is doubled to more clearly show the differences between the character outline and encoded outline.

A String Explosion may be used in the profile of FIG. 20 where the delta angularity 119 is less than 3+ or less than 5° with the angularity of the "second" encoded vector A2 being greater than 40°, indicating Case 1.

The vector outline profile shown contains vectors 61, A2, F3, F3, and F2 with an encoded 00 indicating the end of the vector profile.

The summation of the vectors EY=55 EX=10 indicates a total Y or EY distance of 70 units and a total EX distance of 10 units.

Figure 18:
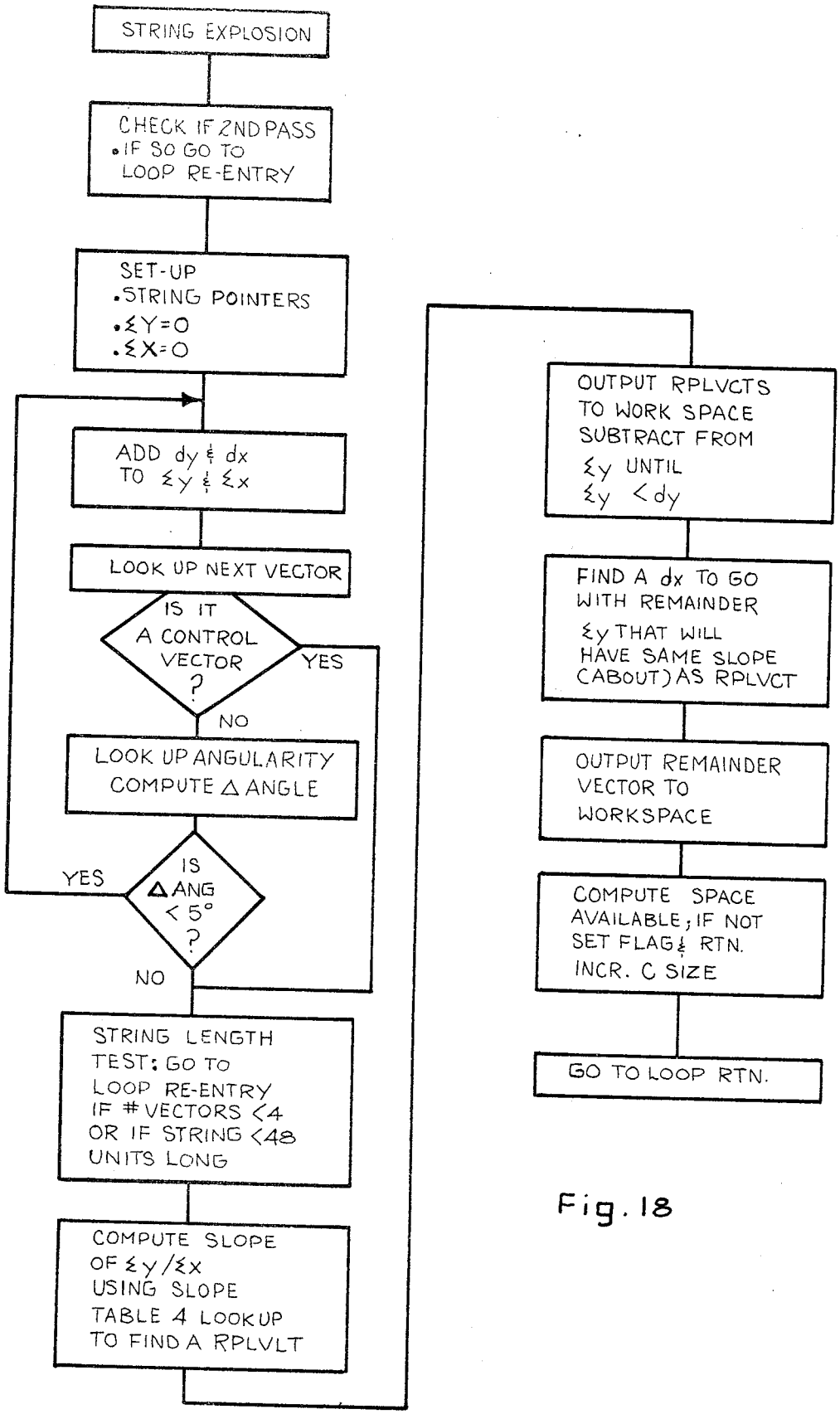
FIG. 18 shows the flow chart for the String Explosion process.

As shown in the flow chart FIG. 18 for the String Explosion, a second pass is not used in the preferred embodiment so the method for smoothing the string outline profile is used only once. A set of registers, containing the accumulative EY, EX coordinate distances is established to provide the x and y values cumlatively totaled for the x and y coordinate distances of the identified vector and additional vectors in the string.

The String Explosion method is a variation of the overall method of smoothing as is the Table Explosion method.

In the String Explosion method according to the principles of the invention the first vector register is loaded with the angularity for vector 61 the "first" vector and the second vector register is loaded with the angularity for vector A2, the "second" vector as shown in FIG. 20. This step is common to the String Explosion and Table Explosion as shown in FIG. 16, and is used to identify the occurrence of Cases 2 or 3 for the string or Table Explosion process of FIGS. 16 & 17.

However, different from the case of the Table Explosion, a replacement vector routine is not immediately inserted in the profile and the EX, EY registers are loaded with the dx and dy coordinate values of the second identified vector A2.

Instead, the additional profile vectors are examined in sequence and compared to the angularity standard initiating the string explosion (Case 1).

The delta angularity between the first two vectors of the outline profile string, vectors 61 and vector A2 being within this standard would initiate the string explosion as shown in FIG. 16.

Each of the successive vectors in the profile are then identified as an additional vector and compared to one of the identified vectors and to the angularity standard initiating the String Explosion.

As shown in FIG. 20, a string profile starts at point 121 and consists of vectors 61, A2, F3, F3, F2 and the terminating code 00 indicating the end of a profile.

Referring back to FIG. 16, the angularity of the first vector 61 is moved to the first register and the angularity of the second vector A2 is moved to the second register. Where control codes are encountered such as 01, 02, 03 or 00, the routine will jump ahead to select the next vector and move it into the appropriate register.

Again referring to FIG. 16, the delta angularity between vectors 61 and vector A2 is determined. Where that delta angularity is less than 3° or less than 5° and with an angularity of at least one of the vectors greater than 40°, a String Explosion is indicated.

The string explosion is shown in greater detail in FIG. 18.

In accordance with the preferred embodiment, a set of string pointer registers Sigma X (EX) and Sigma (EY) is established and each of the vector coordinate distances are added to the appropriate pointer register to determine the running profile length.

The identified vectors in this profile are 61 and A2. As stated their angularity was obtained from a look up table or some other suitable means and compared initiating case 1 or the string explosion, FIG. 16.

In accordance with the preferred embodiment along with the indication of Case 1 the coordinate distances of at least one of the identified vectors, in this case, the second vector or the identified vector furthest from the profile start point 121, is added to the string pointer registers Ex, Ey.

The angularity of the first vector is then compared with the angularity of an additional vector in the profile string, in this case F3.

Assuming the next data word is not a control word, then the angularity of the additional vector is obtained and the delta angularity between the additional vector and the first vector in the string 61, closest to the profile start point 121 is compared.

If the delta angularity is within the standard for case 1 initiating the string explosion process, then a successive additional vector is obtained and its angularity is compared to the angularity of the first vector 61 in the profile string with its coordinate distances being added to the Ex, Ey register accordingly.

The process is iterrated with each successive additional vector in the profile string F3 and F2 where the delta angularity between each successive additional vector and first vector 61 is within the case 1 standard initiating the string explosion.

However, if as shown in FIG. 18, the delta angularity between any additional vector and the first vector in the profile string is outside the case 1 standard initiating the string explosion, then a replacement vector is selected.

The replacement vector is selected by computing the slope of the vector defined by the Ex, Ey registers and using a slope look up table or any other appropriate means to find the replacement vector having that same slope. For example, the replacement vector that approximates vector 117 would be found to be B2. The replacement vector coordinates are then subtracted from the Ex, Ey registers and another replacement vector with the same slope is again used. This process may be interrated until the value of the Ey register is less than the dy value of the replacement vector. A dx is then chosen to go with the remainder dy that will have the same slope.

Additionally, where the next additional or successive vector is a control vector such as 00 shown in FIG. 20, then the process jumps to the replacement vector process as stated above.

Additionally, the process may be arranged so the set of of vectors in the string profile need not be replaced if the profiles are within a length standard such as 4 vectors or 48 delta units.

In the case shown in FIG. 20, the vector string 61, A2, F3, F3, and F2 are five vectors in length, and according to the preferred embodiment, a replacement vector 117 is selected.

The replacement vector 117 would be derived from the summed coordinate distances in the EX EY register EY/EX=55/10

As shown in the preferred embodiment, the EX, EY registers initially contain the summed coordinate distances for the second of the identified profile vectors, A2, shown in FIG. 20. The Ex, Ey registers are then incremented with the coordinate distances of each additional profile vector. The selected replacement vector is then placed within the encoded data to be contiguous with the first vector 61 of the profile string. The replacement vector code replaces the encoded data for the second identified vector and each replaced additional vector.

However, in other implementations of this method and according to the conventions which may be chosen and the character shape desired, the replacement vector can be used to replace all profile vectors, the first identified vector as well as successive vectors in the profile string or the first and second identified vectors may be retained and the replacement vector used to replace only additional vectors in the profile strings as may be appropriate.

For the purpose of explanation, the vectors initially compared and initiating the spring or table explosion shown in FIG. 16 are called the identified vectors.

In the case of the string explosion, each of the successive vectors in the profile string, compared with one of the identified vectors for the string explosion is called an additional vector.

Although not shown, the control code 00 indicating the end of the profile may implement a bottom extrapolation routine as explained with regard to the table explosion.

Any number of suitable techniques may be used to determine if the string length is beyond the standard which would require a replacement vector or small enough so that a replacement vector would be inappropriate.

For example, the address pointer value for the last most recently used additional vector initiating the replacement vector may be compared with the address pointer value for the first identified vector to determine the number of vectors in the profile string. Additionally, the Ex, Ey registers may be used to compute or determine the data unit length of the vector string.

As shown in FIG. 16, a control code encountered in the profile encoded outline data signifies changes in the profile and initiates changes in the process for smoothing the outline profile. Where the next code encountered in the profile are dy dx vector coordinate distances then the method will continue with identified vectors loaded into the registers and the delta angularity obtained. This is indicated as "jump ahead if not" in FIG. 16.

Where a 01 control code is encountered, indicating a change in direction, relative to a reference direction, such as a vertical, then the method of determining the delta angularity is changed.

Figure 21:
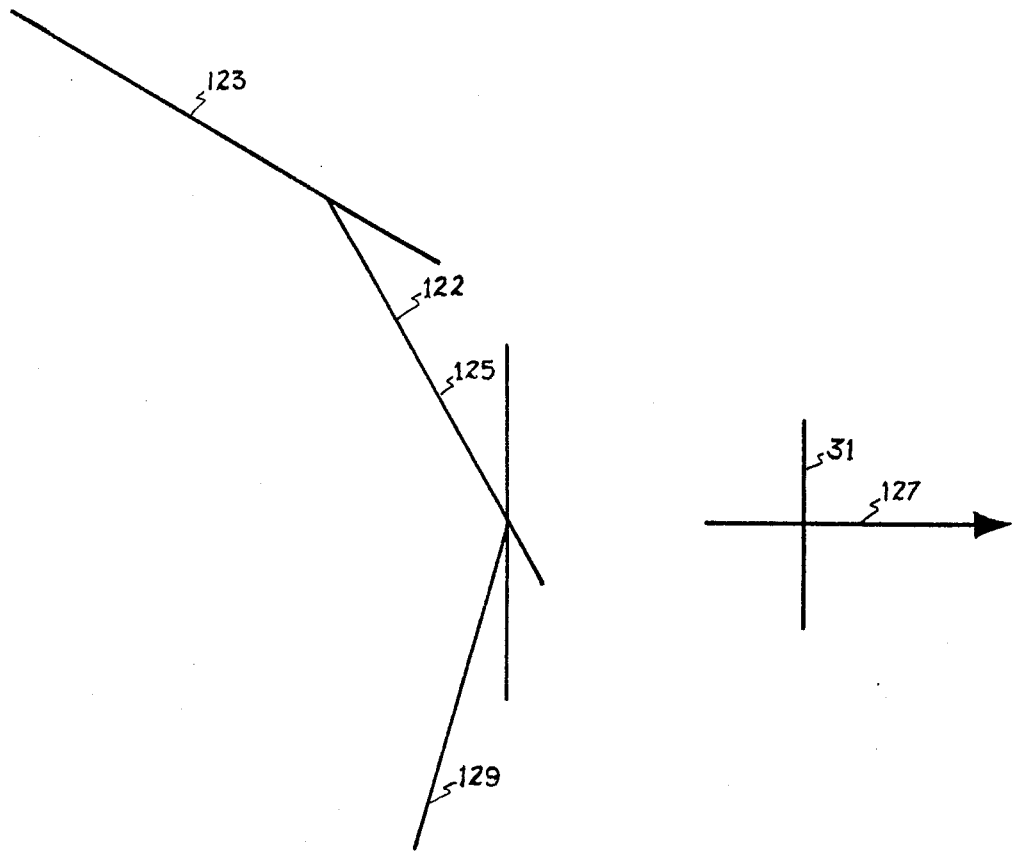
FIG. 21 shows the arrangement of straight lines transversing a change through a reference direction in the outline, such as a vertical parallel to an EM square Side Bearing, and signaling a change in the process for determining delta angularity.

For example, as shown in FIG. 21, the delta angularity 122 between straight lines 123 and 125 may be determined by taking the angularity of lines 123 and 125 relative to the reference angle of straight line 127 and subtracting.

However, the angularity of straight line 129 may need to be added to the angularity of straight line 125 where the reference changes between straight line 125 and 129. This occurs in the encoding of the profiles in the preferred embodiment when as shown, a profile changes direction relative to a vertical 131 parallel to the left or right side bearing of a character. The control 01 then causes a change in the method of determining the delta angularity.

The control word 02 indicates a single point in the outline encoded data. Where this occurs, the exit routine is used and the single point is replaced with 1F and the point becomes a vector which can be implemented in the shape of an outline.

The code 03 indicates a vertical having a dx coordinate distance of 0 and a dy distance equal to the value of the next byte. The microprocessor solves for the y value according to the encoded direction and moves the y value into the work space with the encoded dx value of zero and the routine continues.

The Bottom Exit routine is initiated by the control code 00 at the end of an outline encoded profile.

Where 00 is encountered, a code for the last straight line is added depending on the dx, dy coordinate distances of the last straight line in the profile as explained with regard to the table explosion.

The codes shown are not to be viewed as limiting of the invention, but are used to describe the invention as used in the preferred embodiment.

One skilled in the art would be able to choose an appropriate processor and programming to use the method shown.

I claim:

1. A method of smoothing the outline profiles of variable size characters for display, by altering a normalized encoded character data base comprising a plurality of encoded outline contours extending successively along the character outlines in straight line profiles, each straight line profile having a respective start point and end point, and including the steps of (a) selecting a character and character size for display (b) identifying at least two encoded outline straight lines in a profile, for said character, (c) comparing the angularity of said straight lines to a standard (d) replacing the code for at least one of said identified straight lines with the code for at least two replacement straight lines in response to said comparison, one of said replacement straight lines being continuous with the non-replaced straight line of the said identified outline straight lines, said non-replaced and replacement straight lines defining a smoother outline profile.

2. The method of claim 1, where one of said replacement straight lines defines an angle with the said non-replaced outline straight line less than said angle between said identified two outline straight lines.

3. The method of claim 1, where the said straight lines are encoded vectors.

4. The method of claim 3, where (e) said step (c) of comparing includes the step of comparing the said angularity to a first standard for identifying an encoded straight line profile string and responsive to said straight line profile string identification, said step (d) of replacing including the steps of (f) identifying an additional outline vector in said encoded profile string, (g) summing the vector coordinate distances between the said non-replaced outline vector and said additional outline vector, said summed vector coordinate distances defining the angular direction of said vector string and (h) comparing the delta angularity between said additional outline vector and one of said identified outline vectors to said first standard.

5. The method of claim 4, where said step (d) includes the step (i) of responsive to said comparison step (h) exceeding the said first standard, selecting a replacement straight line vector with a direction corresponding to the said angular direction of summed vector coordinate distances.

6. The method of claim 5, wherein said step (i) includes the step of replacing the code for each said additional vector with the code for said replacement vector.

7. The method of claim 5, wherein said step (i) of selecting the replacement vector includes the steps of (j) determining the vector coordinate distance differences between the summed vector coordinate distances and the coordinate distances of said selected replacement vector and (k) selecting a completion vector having a vector direction corresponding to said replacement vector and with one of said coordinate distances of said completion vector being equal to one of said vector coordinate difference values.

8. The method of claim 5, wherein said additional vectors are successively located along the said outline profile string and the step (l) of repeating steps (f) through (h) in response to said comparison step (h) defining a delta angularity within the said first standard and step (h) includes the step of sequentially comparing the angularity of successive additional vectors of said profile string to the angularity of the said identified outline vector.

9. The method of claim 4, including the step (m) of repeating steps (f) through (h) in response to said comparison defining a delta angularity within the said first standard and terminating the step (m) of repeating responsive to the comparison of the last additional vector in the vector profile string being within the said standard or terminating the step (m) of repeating responsive to the comparison of the last compared additional vector exceeding said first standard and then responsive to said comparison selecting a replacement vector.

10. The method of claim 9, wherein said step (m) of terminating includes the step of defining the cumulative vector string size represented by said summed vector coordinate distances and selecting a replacement vector when said vector string is in excess of a standard size or, where the said vector string length is less than said standard size, retaining all said compared outline vectors in said character outline profile.

11. The method of claim 10, where the angularity of the next vector successive to the replacement vector in the profile string is compared to the angularity of the replacement vector or where the compared vectors are retained, the angularity of the next successive vector in the profile string is compared to the next preceeding vector in the said string, respectively.

12. The method of claim 5, wherein said step (i) of selecting the replacement vector includes the step of defining the cumulative vector string size represented by said summed vector coordinate distances and comparing said string size to a standard size and selecting a replacement vector when said string size exceeds said standard size or retaining said compared vectors of said string in said outline when said string size is less than said standard size.

13. The method of claim 12, wherein said standard size is defined by the number of vectors in said vector string.

14. The method of claim 12, wherein said standard size is defined by the number of encoded data units in said vector string.

15. The method of claim 4, wherein said first standard is a delta angularity less than three degrees or delta angularity greater than three degrees and less than five degrees and with the angle of one of said outline vectors being greater than 40 degrees relative to a reference angle.

16. The method of claim 3, wherein said step (c) of comparing includes the step of comparing said angularity to a second standard, and the step of (o) replacing one of said compared outline vectors with at least two replacement vectors, in response to said comparison, said non-replaced outline vector and one of said replacement vectors forming a lesser angle relative to said compared angle between said identified vectors.

17. The method of claim 16, wherein said step (o) of replacing includes the step (p) of selecting a set of replacement vectors responsive to the delta angularity of said outline vectors.

18. The method of claim 17, wherein said delta angularity is related to a third standard.

19. The method of claim 18, wherein said third standard is an angle, said second standard is an angular range and said third standard angle is within said second standard angular range.

20. The method of claim 16, wherein said step o of replacing includes the step of determining the delta angularity of said outline vectors.

21. The method of claim 16, wherein said step of comparing, compares the delta angularity between said identified vectors and said step of replacing includes the step of selecting a replacement vector by comparing said delta angularity to a third standard and selecting a replacement vector responsive to said comparison to said third standard.

22. The method of claim 21, wherein said second standard is an angular range.

23. The method of claim 22, wherein said third standard is a reference angle.

24. The method of claim 22, wherein said second standard is a range of 10° to 60°.

25. The method of claim 23, wherein said reference angle is 25°.

26. The method of claim 21, wherein said step (o) of replacing includes the step of determining the relative angularity of the said identified vectors and selecting a replacement vector responsive to the relative angularity.

27. The method of claim 26, wherein the said determination of relative angularity indicates which of the two identified vectors is steeper than said other identified vector.

28. The method of claim 19, wherein the said third standard is 25°.

29. The method of claim 28, wherein the said second standard is 10° to 60°.

30. The method of claim 21, wherein said step (o) of replacing includes the step of selecting a table of replacement vectors from a plurality of tables responsive to said comparison to said third standard.

31. An apparatus for smoothing the outline profiles of a variable size characters for display, by altering a normalized encoded character data base comprising a plurality of encoded outline contours extending successively along the character outline in straight line outline profiles, each outline profile having a respective start point and end point and comprising (a) means for selecting a character and character size for display (b) means for identifying at least two encoded outline straight lines in a profile; for said character, (c) means for comparing the angularity between said straight lines to a standard (d) means for replacing the code for at least one of said identified straight lines with the code for at least two replacement straight lines in response to said comparison said non-replaced straight line and replaced straight line defining a smoother outline profile angle.

32. The apparatus of claim 31, wherein said encoded straight line outline profiles are encoded vectors.

33. The apparatus of claim 31, wherein said replacement straight line defines an angle with said non-replaced identified straight line less than said angle between said identified straight lines.

34. The apparatus of claim 33, wherein said means for comparing said identified vectors includes means for comparing the said angularity to a first standard for identifying an encoded vector profile string and said means for replacing being responsive to said vector profile string identification and including (f) means for identifying an additional outline vector in said encoded profile string (g) means for summing the vector coordinate distances between an identified outline vector and said additional outline vector, said summed vector coordinate distances defining the angular direction of said vector string and (h) means for comparing the angularity between said additional outline vector and an identified outline vector to said first standard.

(i) means responsive to said means for comparing the angularity of said additional outline vector and said identified outline vector for selecting a replacement vector with a vector direction being that of said summed vector coordinate distances.

35. The apparatus of claim 34, wherein said means for comparing the said identified vectors includes a first store for storing a table of vector angularities, means for selecting respective angularities from said first store for each of said identified vectors and means responsive to said selected angularities for producing an indication of the delta angularity between said identified vectors.

36. The apparatus of claim 35, wherein said means for selecting a replacement vector includes means for determining the vector coordinate distance differences between said summed vector coordinate distances and the coordinate distances of said selected replacement vector and means for selecting a completion vector having a vector direction corresponding to said replacement vector and with at least one of said coordinate distances of said completion vector being equal to at least one of said vector coordinate distance differences.

37. The apparatus of claim 36, wherein said means is for selecting a replacement vector includes means responsive to said comparison of said additional outline vector for selecting said replacement vector responsive to said comparison exceeding the said first standard, or for selecting a successive additional vector on said vector string responsive to said comparison being within said first standard, said comparing means comparing the angularity between the said successive additional vector with said identified outline vector to said first standard, to determine the delta angularity, means for summing the vector coordinate distances of said successive additional vector with said preceding vector in the string.

38. The apparatus of claim 34, where said means for selecting a replacement vector includes means for determining the vector string length and comparing the said length to a second standard and selecting said replacement vector responsive to said vector length exceeding said second standard or, responsive to said vector length being within said second standard, selecting a further successive additional outline vector in said profile string and comparing the angularity between said further successive additional outline vector and said identified outline vector, and said means for replacing said vector profile string being responsive to the said delta angularity.

39. The apparatus of claim 32, wherein said means for comparing to a standard includes means for comparing the said identified vectors to a third standard and said means for replacing, replacing one of said outline vectors with at least two replacement vectors responsive to said comparison and with said non-replaced outline vector being contiguous to said replacement vector and forming a lesser angle with said replacement vector relative to said compared angle.

40. The apparatus of claim 39, wherein said means for replacing includes means for determining the delta angularity of the said outline vectors and means for selecting a set of replacement vectors responsive to said delta angularity.

41. The apparatus of claim 39, wherein said means for replacing compares said outline vector delta angularity to a fourth standard and selects said replacement vector responsive to said comparison of said delta angularity to said fourth standard.

42. The apparatus of claim 41, wherein said means for replacing includes a plurality of replacement vector tables, said replacement table including means for selecting a replacement vector table responsive to said fourth standard comparison.

43. The apparatus of claim 42, where said fourth standard is an angle.

44. The apparatus of claim 42, where said means for replacing includes means for determining the relative angularity of said identified vectors and said means for selecting includes means for selecting a replacement vector table responsive to said relative angularity.

45. The apparatus of claim 39, where said third standard is an angular range.

46. The apparatus of claim 44, where said fourth standard is an angle.

* * * * *